US009862211B2

(12) United States Patent
Yoshida

(10) Patent No.: US 9,862,211 B2
(45) Date of Patent: Jan. 9, 2018

(54) CONTROL DEVICE AND NON-TRANSITORY COMPUTER-READABLE MEDIUM

(71) Applicant: BROTHER KOGYO KABUSHIKI KAISHA, Nagoya-shi, Aichi-ken (JP)

(72) Inventor: Yasunari Yoshida, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/362,051

(22) Filed: Nov. 28, 2016

(65) Prior Publication Data

US 2017/0151816 A1 Jun. 1, 2017

(30) Foreign Application Priority Data

Nov. 30, 2015 (JP) ..... 2015-232842

(51) Int. Cl.
*B41J 13/00* (2006.01)
*B41J 3/60* (2006.01)

(52) U.S. Cl.
CPC ..... *B41J 13/0009* (2013.01); *B41J 3/60* (2013.01)

(58) Field of Classification Search
CPC ..... B41J 13/0009; B41J 3/60
See application file for complete search history.

(56) References Cited

U.S. PATENT DOCUMENTS 6,578,944 B1 6/2003 Kamei et al.
9,604,478 B1 * 3/2017 Montfort ..... B41J 13/0009
9,623,683 B2 * 4/2017 Kojima ..... B41J 13/0009
2005/0030333 A1 2/2005 Takahashi et al.
2007/0057996 A1 3/2007 Yazawa et al.
2015/0035891 A1 2/2015 Yoshida et al.

FOREIGN PATENT DOCUMENTS

JP 11-84745 A 3/1999
JP 2001-071479 A 3/2001
JP 2005-059318 A 3/2005
JP 2005-271231 A 10/2005
JP 2006-044060 A 2/2006
JP 2010-179656 A 8/2010
JP 2015-030149 A 2/2015

* cited by examiner

*Primary Examiner* — Lamson Nguyen
(74) *Attorney, Agent, or Firm* — Merchant & Gould P.C.

(57) ABSTRACT

A control device of a printing execution mechanism executing: first control processing including: conveying a sheet to a first position at which the sheet is held by an upstream holding member of the conveyance mechanism, is not held by a downstream holding member of the conveyance mechanism, and a downstream end of the sheet is located between the upstream and downstream holding members; and printing on a first surface of the sheet; and second control processing including: conveying the sheet to a second position at which the sheet is held by the upstream holding member, is not held by the downstream holding member, and the downstream end of the sheet is located at a more upstream side than the downstream end of the sheet located at the first position; and printing on a second surface of the sheet.

19 Claims, 13 Drawing Sheets

CONTROL DEVICE AND NON-TRANSITORY COMPUTER-READABLE MEDIUM

CROSS-REFERENCE TO RELATED APPLICATION

This application claims priorities from Japanese Application Publication No. 2015-232842 filed on Nov. 30, 2015, the entire subject matter of which is incorporated herein by reference.

TECHNICAL FIELD

The disclosure relates to a technology of controlling printing, and particularly, to a technology of controlling conveyance of a sheet and driving of a printing head during duplex printing.

BACKGROUND

A printer configured to discharge liquid droplets of ink or the like onto a sheet and to form dots for printing has been known. The printer is configured to convey the sheet from an upstream side toward a downstream side with holding the sheet by using a roller disposed at a more upstream side than a printing head and a roller disposed at a more downstream side than the printing head, for example. In this case, a printing on a central part in a conveying direction of the sheet is executed with the sheet being held by both the rollers. Incidentally, a printing adjacent to a sheet end, for example, a downstream end or an upstream end is executed at a state where the sheet is held by one roller and is not held by the other roller.

At the state where the sheet is held only by one roller, the sheet is more likely to be deformed, depending on the gravity, types of the sheet, mounting environments of the printer and the like, as compared to a state where the sheet is held by both the rollers. The deformation of the sheet may vary a gap between the printing head and the sheet and cause the sheet and the printing head to contact each other. For this reason, deterioration of a printing quality such as positional deviation of the dots and smudge of the sheet may be caused due to the deformation of the sheet.

There has been disclosed a technology of contriving a conveying amount of the sheet to shorten a distance from a position on the sheet held by one roller to an end of the sheet when the printing is executed with the sheet being held only by one roller. According to the related-art technology, it is possible to suppress the deterioration of the printing quality by suppressing the deformation of the sheet.

SUMMARY

There may be provided a control device of a printing execution mechanism, the printing execution mechanism comprising: a printing head having a plurality of nozzles configured to discharge liquid droplets; and a conveyance mechanism configured to convey a sheet in a conveying direction, the conveyance mechanism comprising: an upstream holding member provided at a more upstream side than the printing head in the conveying direction, the upstream holding member being configured to hold the sheet; and a downstream holding member provided at a more downstream side than the printing head in the conveying direction, the downstream holding member being configured to hold the sheet, the printing execution mechanism being configured to perform a printing by alternately executing a partial printing by the printing head and conveyance of the sheet by the conveyance mechanism for a plurality of times, the control device being configured to: execute first control processing of controlling the printing execution mechanism to perform the printing on a first surface of the sheet, the first control processing comprising: conveying the sheet to a first position in the conveying direction by the conveyance mechanism, the first position being a position at which: the sheet is to be held by the upstream holding member; the sheet is not to be held by the downstream holding member; and a downstream end of the sheet is located between the upstream holding member and the downstream holding member; and starting the printing on the first surface of the sheet by executing the partial printing on the first surface of the sheet located at the first position by the printing head after the sheet is conveyed to the first position in the first control processing; and execute second control processing of controlling the printing execution mechanism to perform the printing on a second surface of the sheet after the first control processing is executed, the second control processing comprising: conveying the sheet to a second position in the conveying direction by the conveyance mechanism, the second position being a position at which: the sheet is to be held by the upstream holding member; the sheet is not to be held by the downstream holding member; and the downstream end of the sheet is located at a more upstream side than the downstream end of the sheet located at the first position; and starting the printing on the second surface of the sheet by executing the partial printing on the second surface of the sheet located at the second position by the printing head after the sheet is conveyed to the second position in the second control processing.

According to the above configuration, during the printing on the second surface of the sheet, the partial printing on the region adjacent to the downstream end in the conveying direction of the sheet upon the start of printing is performed at a state where the downstream end of the sheet is located at the more upstream side than the downstream end of the sheet located at the first position. That is, during the printing on the second surface of the sheet, the partial printing on the region adjacent to the downstream end of the sheet is performed at the state where the distance from the upstream holding part to the downstream end of the sheet is shorter, as compared to the printing on the first surface of the sheet. The sheet after the printing on the first surface may be deformed. However, according to the above configuration, during the printing on the second surface, when performing the printing on the region adjacent to the downstream end of the sheet upon the start of printing, it is possible to suppress the deformation of the sheet due to the liquid droplets attached to the sheet during the printing on the first surface. Therefore, it is possible to reduce deterioration of a printing quality in the vicinity of the downstream end of the sheet and to implement the appropriate duplex printing capable of reducing the deterioration of the printing quality.

There may be provided a control device of a printing execution mechanism, the printing execution mechanism comprising: a printing head having a plurality of nozzles configured to discharge liquid droplets and a conveyance mechanism configured to convey a sheet in a conveying direction, the conveyance mechanism comprising: an upstream holding member provided at a more upstream side than the printing head in the conveying direction, the upstream holding member being configured to hold the sheet; and a downstream holding member provided at a more downstream side than the printing head in the conveying direction, the downstream holding member being configured to hold the sheet, the printing execution mechanism being configured to perform a printing by alternately executing a partial printing by the printing head and conveyance of the sheet by the conveyance mechanism for a plurality of times, the control device being configured to: execute first control processing of controlling the printing execution mechanism to perform the printing on a first surface of the sheet, the first control processing comprising: conveying the sheet to a first position in the conveying direction by the conveyance mechanism; and starting the printing on the first surface by executing the partial printing on the first surface of the sheet located at the first position by using N1 nozzles of the plurality of nozzles by the printing head after the sheet is conveyed to the first position in the first control processing, where N1 is an integer of 2 or greater, execute second control processing of controlling the printing execution mechanism to perform the printing on a second surface of the sheet after the first control processing is executed, the second control processing comprising: conveying the sheet to a second position in the conveying direction by the conveyance mechanism; and starting the printing on the second surface by executing the partial printing on the second surface of the sheet located at the second position by using N2 nozzles of the plurality of nozzles by the printing head after the sheet is conveyed to the second position in the second control processing, where N2 is an integer of 1 or greater and less than N1, and wherein the first position and the second position are positions at which: the sheet is to be held by the upstream holding member; the sheet is not to be held by the downstream holding member; and a downstream end of the sheet is located between the upstream holding member and the downstream holding member.

According to the above configuration, during the printing on the second surface of the sheet, the printing on the region adjacent to the downstream end in the conveying direction of the sheet upon the start of printing is performed using the nozzles of which the number is smaller than the nozzles during the printing processing on the first surface of the sheet. The sheet after the printing on the first surface may be deformed. However, according to the above configuration, during the printing on the second surface, when performing the printing on the region adjacent to the downstream end of the sheet, it is possible to suppress the deformation of the sheet due to the liquid droplets attached to the sheet during the printing on the first surface. Therefore, it is possible to reduce the deterioration of the printing quality in the vicinity of the downstream end of the sheet upon the start of printing and to implement the appropriate duplex printing capable of reducing the deterioration of the printing quality.

Incidentally, the disclosure can be implemented in a variety of forms. For example, the disclosure can be implemented in forms of a printing apparatus, a printing method, a computer program for implementing functions of the apparatus or the method, a recording medium having the computer program recorded therein, and the like.

DETAILED DESCRIPTION

A sheet having one printed surface on which the liquid droplets have been discharged may be deformed due to the liquid droplets attached to the sheet during the printing on the one surface, as compared to the sheet before the printing. Therefore, regarding duplex printing, when performing the printing on one surface of the sheet of which both surfaces have not been printed yet and when performing the printing on the other surface of the sheet of which one surface has been already printed, states of the sheet may be different during each printing. However, in the above-described related-art technology, a difference of the states of the sheet upon printing on each surface during the duplex printing has not been considered, so that the appropriate printing may not be performed.

Therefore, the disclosure provides a technology by which appropriate duplex printing capable of reducing deterioration of a printing quality can be implemented.

(Configuration of Printing Apparatus)

Figure 1:
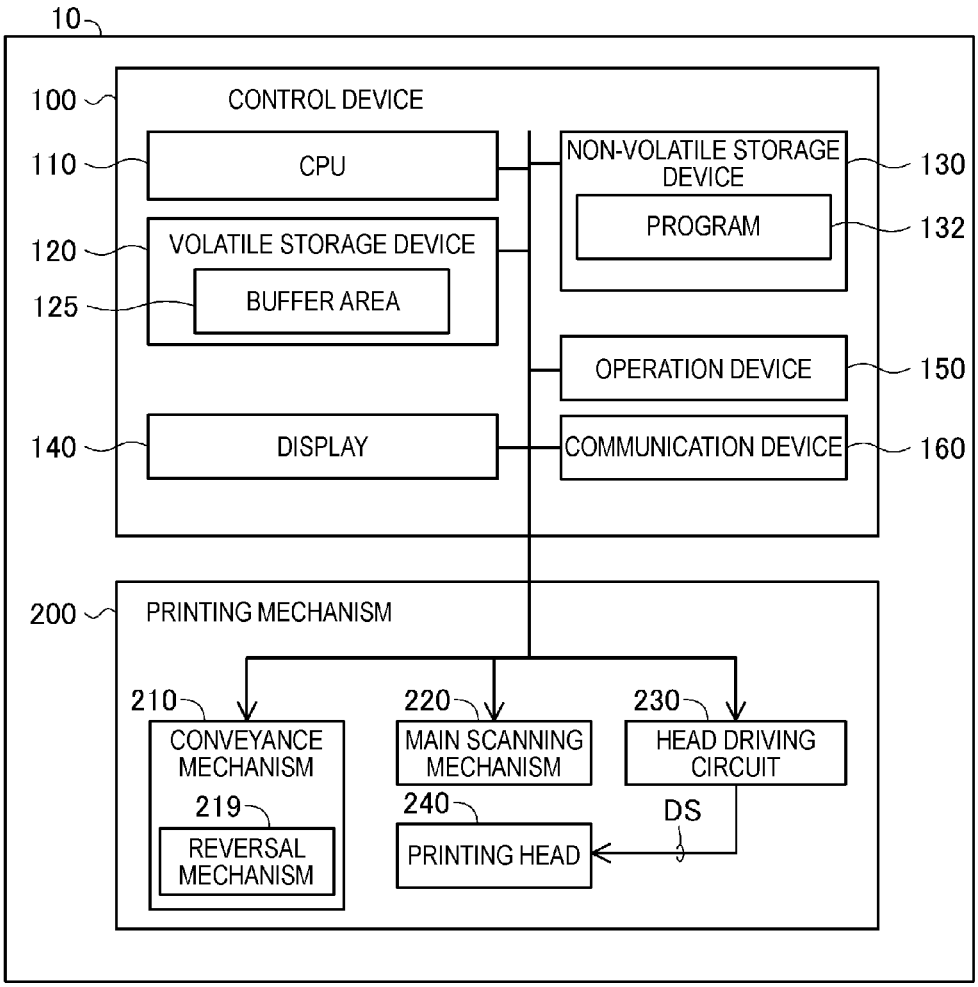
FIG. 1 is a block diagram depicting a configuration of a printer 10 according to an illustrative embodiment.

Hereinafter, an illustrative embodiment of the disclosure will be described. FIG. 1 is a block diagram depicting a configuration of a printer 10 according to an illustrative embodiment. The printer 10 is an inkjet printer configured to form dots on a sheet by using liquid droplets (specifically, ink of a color material), thereby performing printing. The printer 10 includes a control device 100 configured to control the entire printer and a printing mechanism 200 serving as the printing execution unit of the illustrative embodiment.

The control device 100 includes a CPU 110, a volatile storage device 120 such as a DRAM or the like, a non-volatile storage device 130 such as a flash memory, a hard disk drive or the like, a display 140 such as a liquid crystal monitor, an operation device 150 including a touch panel overlapping with a panel of the liquid crystal monitor, buttons and the like, and a communication device 160 including a communication interface for performing communication with an external apparatus such as a personal computer (not shown).

The volatile storage device 120 is provided with a buffer area 125 configured to temporarily store therein a variety of intermediate data, which is to be generated when the CPU 110 executes processing. In the non-volatile storage device 130, a computer program 132 for controlling the printer 10 is stored.

The computer program 132 is stored in advance in the non-volatile storage device 130 upon shipment of the printer 10. On the other hand, the computer program 132 may be stored in a DVD-ROM or the like or may be downloaded from a server. The CPU 110 is configured to implement control processing of the printer 10 (which will be described later) by executing the computer program 132.

The printing mechanism 200 has a conveyance mechanism 210, a main scanning mechanism 220, a head driving circuit 230 and a printing head 240. The conveyance mechanism 210 has a conveyance motor (not shown) and is configured to convey a sheet in a conveying direction along a predetermined conveyance path by power of the conveyance motor. The main scanning mechanism 220 has a main scanning motor (not shown), and is configured to reciprocally move (simply referred to as "main scanning") the printing head 240 in a main scanning direction by power of the main scanning motor. The head driving circuit 230 is configured to supply a driving signal DS to the printing head 240 and to drive the printing head 240 while the main scanning mechanism 220 performs the main scanning of the printing head 240. The printing head 240 is configured to discharge respective inks of cyan (C), magenta (M), yellow (Y) and black (K) and to form dots on a sheet, which is being conveyed by the conveyance mechanism 210, in response to the driving signal DS. Although described in detail later, the printing mechanism 200 can execute a printing where a partial printing by the printing head 240 and conveyance of a sheet M by the conveyance mechanism 210 are alternately executed more than once to perform the printing, in accordance with control of the CPU 110 of the control device 100. The partial printing is a printing, which is to be performed by the printing head 240 during one-time main scanning, of an image that is a part of an image to be printed.

Figure 2:
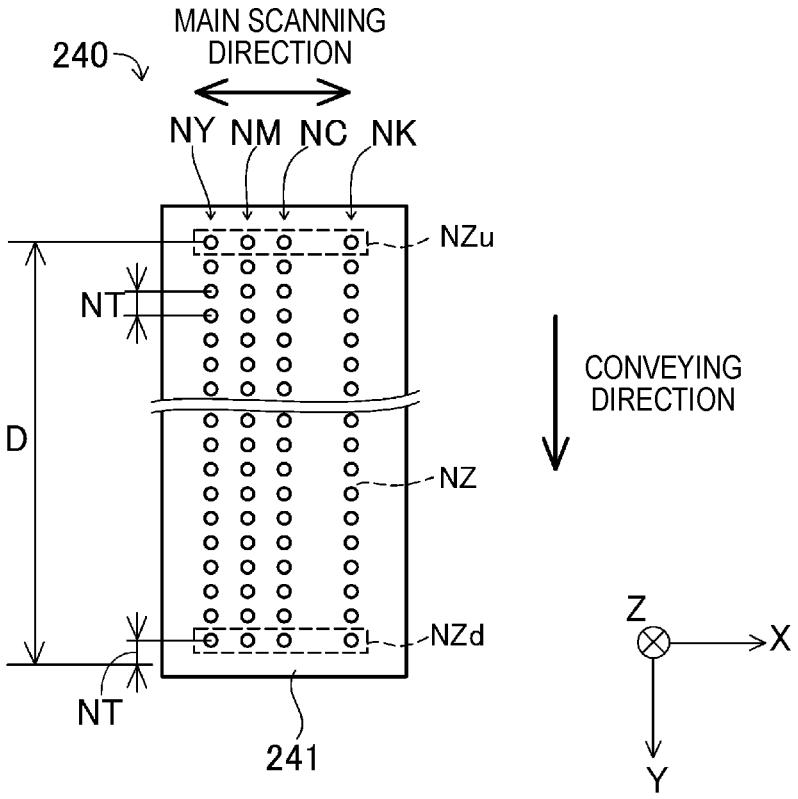
FIG. 2 depicts a schematic configuration of a printing head 240.

FIG. 2 depicts a schematic configuration of the printing head 240. A nozzle formation surface 241 (−Z-side surface) of the printing head 240 is formed with nozzle lines NC, NM, NY, NK configured to discharge the respective inks of cyan (C), magenta (M), yellow (Y) and black (K). Each nozzle line includes a plurality of nozzles NZ. The plurality of nozzles NZ is different in terms of positions in the conveying direction, and is aligned with a predetermined nozzle interval NT in the conveying direction. The nozzle interval NT is a length in the conveying direction between two nozzles NZ adjacent to each other in the conveying direction of the plurality of nozzles NZ. Meanwhile, in FIG. 2 and thereafter, a +Y direction indicates the conveying direction (sub-scanning direction) of the sheet, and an X direction indicates the main scanning direction. A nozzle NZ, which is positioned at the most downstream side in the conveying direction, of the plurality of nozzles NZ included in each nozzle line, i.e., a nozzle NZ positioned at a +Y-side end of FIG. 2 is also referred to as the most downstream nozzle NZd, and a nozzle NZ positioned at the most upstream side in the conveying direction, i.e., a nozzle NZ positioned at a −Y-side end of FIG. 2 is also referred to as the most upstream nozzle NZu. A length obtained by adding the nozzle interval NT to a length in the conveying direction from the most upstream nozzle NZu to the most downstream nozzle NZd is also referred to as a nozzle length D.

Figure 3A:
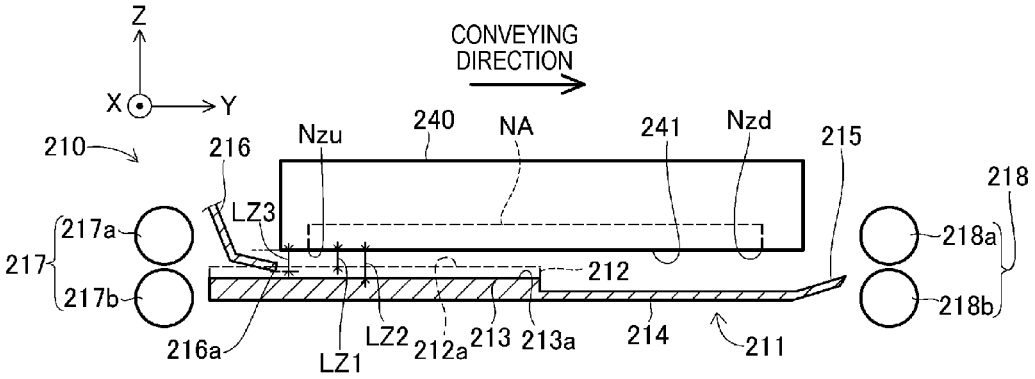
FIGS. 3A to 3C each depicts a schematic configuration of a conveyance mechanism 210.
Figure 3B:
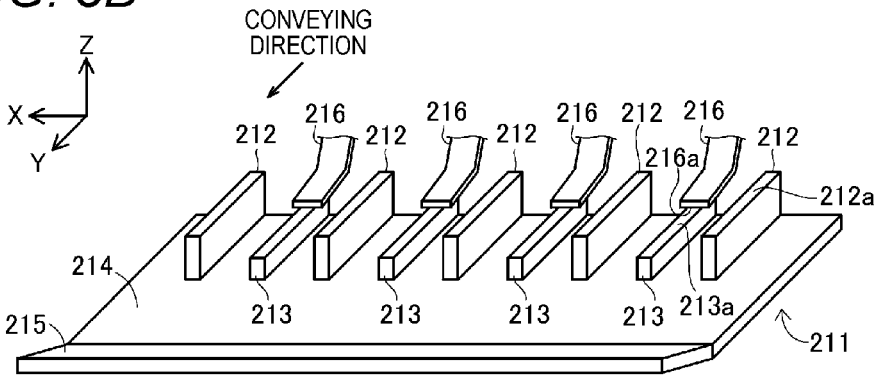
Figure 3C:
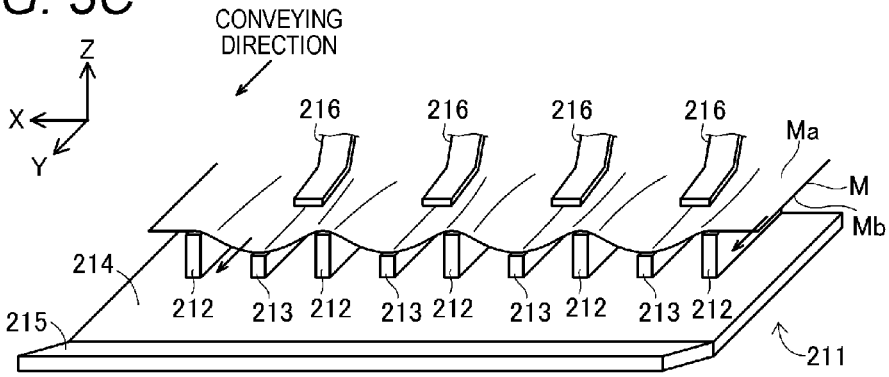

FIGS. 3A to 3C each depicts a schematic configuration of the conveyance mechanism 210. As shown in FIG. 3A, the conveyance mechanism 210 has a sheet stand 211, a pair of upstream rollers 217 for holding and conveying the sheet, a pair of downstream rollers 218, and a plurality of pressing members 216.

The pair of upstream rollers 217 is provided at a more upstream side (−Y-side) than the printing head 240 with respect to the conveying direction, and the pair of downstream rollers 218 is provided at a more downstream side (+Y-side) than the printing head 240 with respect to the conveying direction. The pair of upstream rollers 217 includes a driving roller 217*a* configured to drive by a conveyance motor (not shown) and a driven roller 217*b* configured to rotate in conformity to rotation of the driving roller 217*a*. Likewise, the pair of downstream rollers 218 includes a driving roller 218*a* and a driven roller 218*b*. Incidentally, a plate member may be adopted instead of the driven roller, and the sheet may be held by the driving roller and the plate member.

The sheet stand 211 is arranged at a position facing the nozzle formation surface 241 of the printing head 240 between the pair of upstream rollers 217 and the pair of downstream rollers 218. The plurality of pressing members 216 is arranged between the pair of upstream rollers 217 and the printing head 240.

In FIGS. 3B and 3C, perspective views of the sheet stand 211 and the plurality of pressing members 216 are shown. FIG. 3B depicts a state where the sheet M is not supported, and FIG. 3C depicts a state where the sheet M is supported. The sheet stand 211 has a plurality of high support members 212, a plurality of low support members 213, a flat plate 214 and an inclined part 215.

The flat plate 214 is a plate member substantially parallel with the main scanning direction (X direction) and the conveying direction (+Y direction). A −Y-side end portion of the flat plate 214 is located at a −Y-side position of a −Y-side end portion of the printing head 240, and is positioned in the vicinity of the pair of upstream rollers 217. The inclined part 215 is a plate member positioned at the +Y-side of the flat plate 214 and inclined upward toward the +Y direction. An end portion of the inclined part 215 is located at a +Y-side position of a +Y-side end portion of the printing head 240, and is positioned in the vicinity of the pair of downstream rollers 218. A length in the X direction of the flat plate 214 is longer than a length in the X direction of the sheet M to be conveyed by a predetermined amount. Thereby, when a borderless printing by which the sheet M can be printed up to both ends in the X direction is executed so as not to leave a blank space at both ends in the X direction of the sheet M, it is possible to receive the ink, which is to be discharged to outer sides of both ends in the X direction of the sheet M, by the flat plate 214.

The plurality of high support members 212 and the plurality of low support members 213 are alternately aligned on the flat plate 214 in the X direction. That is, each low support member 213 is arranged between the two high support members 212 adjacent to the corresponding low support member. Each high support member 212 is a rib extending in the Y direction. A −Y-side end portion of each high support member 212 is positioned at the −Y-side end portion of the flat plate 214. A +Y-side end portion of each high support member 212 is positioned at a central portion in the Y direction of the flat plate 214. It can also be said that the +Y-side end portion of each high support member 212 is positioned at a central portion in the Y direction of a region NA where the plurality of nozzles NZ of the printing head 240 is formed. Positions of both ends in the Y direction of each low support member 213 are the same as the positions of both ends in the Y direction of the high support member 212.

The plurality of pressing members 216 is provided at positions in the Y direction between the pair of upstream rollers 217 and the most upstream nozzles NZu. It can also be said that the plurality of pressing members 216 is located at positions in the Y direction between the −Y-side ends and the +Y-side ends of the high support members 212 and the low support members 213. Also, the plurality of pressing members 216 is positioned at a +Z-side of the plurality of low support members 213. The positions in the X direction of the plurality of pressing members 216 are the same as the positions in the X direction of the plurality of low support members 213. That is, the position in the X direction of each pressing member 216 is located between the two high support members 212 adjacent to the corresponding pressing member. Each of the plurality of pressing members 216 is a plate member inclined to be closer to the low support member 213 as it faces toward the +Y direction. The +Y-side end portions of the plurality of pressing members 216 are positioned between the −Y-side end portion of the printing head 240 and the pair of upstream rollers 217.

The plurality of high support members 212, the plurality of low support members 213 and the plurality of pressing members 216 are disposed at positions closer to the pair of upstream rollers 217 than the pair of downstream rollers 218, and can also be said to be provided at the pair of upstream rollers 217-side between the pair of upstream rollers 217 and the pair of downstream rollers 218.

As shown in FIG. 3C, during the conveyance of the sheet M, the plurality of high support members 212 and the plurality of low support members 213 support the sheet M from an opposite surface Mb-side to a printing surface Ma, and the plurality of pressing members 216 supports the sheet M from the printing surface Ma-side. The printing surface Ma is a surface facing the nozzle formation surface 241 of the printing head 240 during the conveyance of the sheet M. A position at which each high support member 212 supports the sheet M (i.e., a position of a +Z-side surface 212*a* of each high support member 212 (FIG. 3A) is located at the +Z-side of a position at which each low support member 213 supports the sheet M (i.e., a position of a +Z-side surface 213*a* of each low support member 213 (FIG. 3A). In other words, a distance LZ1 between the position at which each high support member 212 supports the sheet M and a plane including the nozzle formation surface 241 of the printing head 240 is shorter than a distance LZ2 between the position at which each low support member 213 supports the sheet M and the plane including the nozzle formation surface 241.

The position at which each high support member 212 supports the sheet M is located at the +Z-side of a position at which each pressing member 216 supports the sheet M (i.e., a −Z-side portion 216*a* of the +Y-side end portion of each pressing member 216 (FIG. 3A). In other words, the distance LZ1 between the position at which each high support member 212 supports the sheet M and the plane including the nozzle formation surface 241 of the printing head 240 is shorter than a distance LZ3 between the position at which each pressing member 216 supports the sheet M and the plane including the nozzle formation surface 241.

For this reason, the sheet M is supported with being deformed into a waveform in the X direction by the plurality of high support members 212, the plurality of low support members 213 and the plurality of pressing members 216 (FIG. 3C). The sheet M is conveyed with being deformed into a waveform in the conveying direction (+Y direction). When the sheet M is deformed into a waveform, it is possible to increase the rigidity of the sheet M against the deformation in the Y direction. As a result, it is possible to suppress a situation where the sheet M is deformed to bend in the Y direction and thus the sheet M floats from the sheet stand 211 toward the printing head 240 or the sheet M hangs down toward the sheet stand 211. When the sheet M floats or hangs down, an image quality of a printed image may be deteriorated due to deviation of the dot formation position. Also, when the sheet M floats, the sheet is contacted to the printing head 240, so that the sheet M may be dirtied.

Incidentally, when a fiber direction of the sheet is parallel with the X direction, the sheet is more likely to be bent during the printing, as compared to a case where the fiber direction of the sheet is parallel with the Y direction. Also, when a printing is performed at a state where a longitudinal direction of the sheet M having an A4 or A3 size is parallel with the X direction and a width direction of the sheet M is parallel with the Y direction, the sheet is relatively likely to be bent in the Y direction. Therefore, in these cases, it is highly necessary to convey the sheet M with being deformed into a waveform.

Incidentally, the conveyance mechanism 210 further has a reversal mechanism 219 (FIG. 1). After the printing on the first surface of the sheet M has completed, the reversal mechanism 219 reverses the sheet M discharged to the +Y-side of the pair of downstream rollers 218 so that a second surface opposite to the first surface becomes a printing surface, and again supplies the sheet from the −Y-side of the pair of upstream rollers 217, i.e., the upstream side of the conveying direction. Since the detailed configuration of the reversal mechanism 219 has been known, the description thereof is omitted.

As can be seen from the above description, the plurality of high support members 212 and the plurality of low support members 213 are examples of the second support member, the third support member and the fifth support member, and the plurality of pressing members 216 is an example of the first support member and the fourth support member. The pair of upstream rollers 217 is an example of the upstream holding part, and the pair of downstream rollers 218 is an example of the downstream holding part.

(Operations of Printing Apparatus)

The CPU 110 of the printer 10 is configured to execute duplex printing processing on the basis of an instruction from a user. Specifically, the CPU 110 of the printer 10 is configured to acquire first image data indicative of a first image to be printed on the first surface of the sheet M and second image data indicative of a second image to be printed on the second surface of the sheet M, based on an instruction from a user. The first image data and the second image data are image data compressed with a predetermined format, for example, JPEG or image data described with a page description language, and are acquired from an external apparatus such as a personal computer C, a smart phone and the like, for example.

The CPU 110 is configured to execute well-known processing such as rasterizing processing, color conversion processing, halftone processing and the like for the acquired first image data and second image data, thereby generating dot data. The rasterizing processing is processing of converting the acquired image data into RGB image data including gradation values of three components of RGB, for example. The color conversion processing is processing of converting the RGB image data into CMYK image data including gradation values of components corresponding to colors of inks (for example, four colors of CMYK). The halftone processing is processing of converting the CMYK image data into dot data indicative of dot formation states for each pixel to be included in a printed image. The dot formation state of each pixel is expressed by two gradations of "no dot" and "there is dot" or four gradations of 'no dot", "small", "intermediate" and "large", for example.

The CPU 110 is configured to execute control processing of duplex printing, in which the CPU controls the printing mechanism 200 to execute the duplex printing, by using the generated dot data. Both the printing on the first surface and the printing on the second surface are executed by alternately repeating conveying processing (also referred to as sub-scanning processing) and main scanning processing. In one-time conveying processing, the CPU 110 is configured to control the conveyance mechanism 210 to convey the sheet M by a predetermined conveying amount. In one-time main scanning processing, the CPU 110 is configured to control the main scanning mechanism 220 (FIG. 1) with the sheet M being stationary, thereby moving once the printing head 240 (FIGS. 1 and 2) in the main scanning direction (X direction). In the one-time main scanning processing, the CPU 110 is further configured to supply the driving signal DS from the head driving circuit 230 (FIG. 1) to the printing head 240 during the movement of the printing head 240, thereby discharging the inks from the plurality of nozzles NZ of the printing head 240. A partial image, which is to be printed by the one-time main scanning processing, of an image to be printed (a first image or a second image) is also referred to as a partial image corresponding to the one-time main scanning processing.

Figure 4:
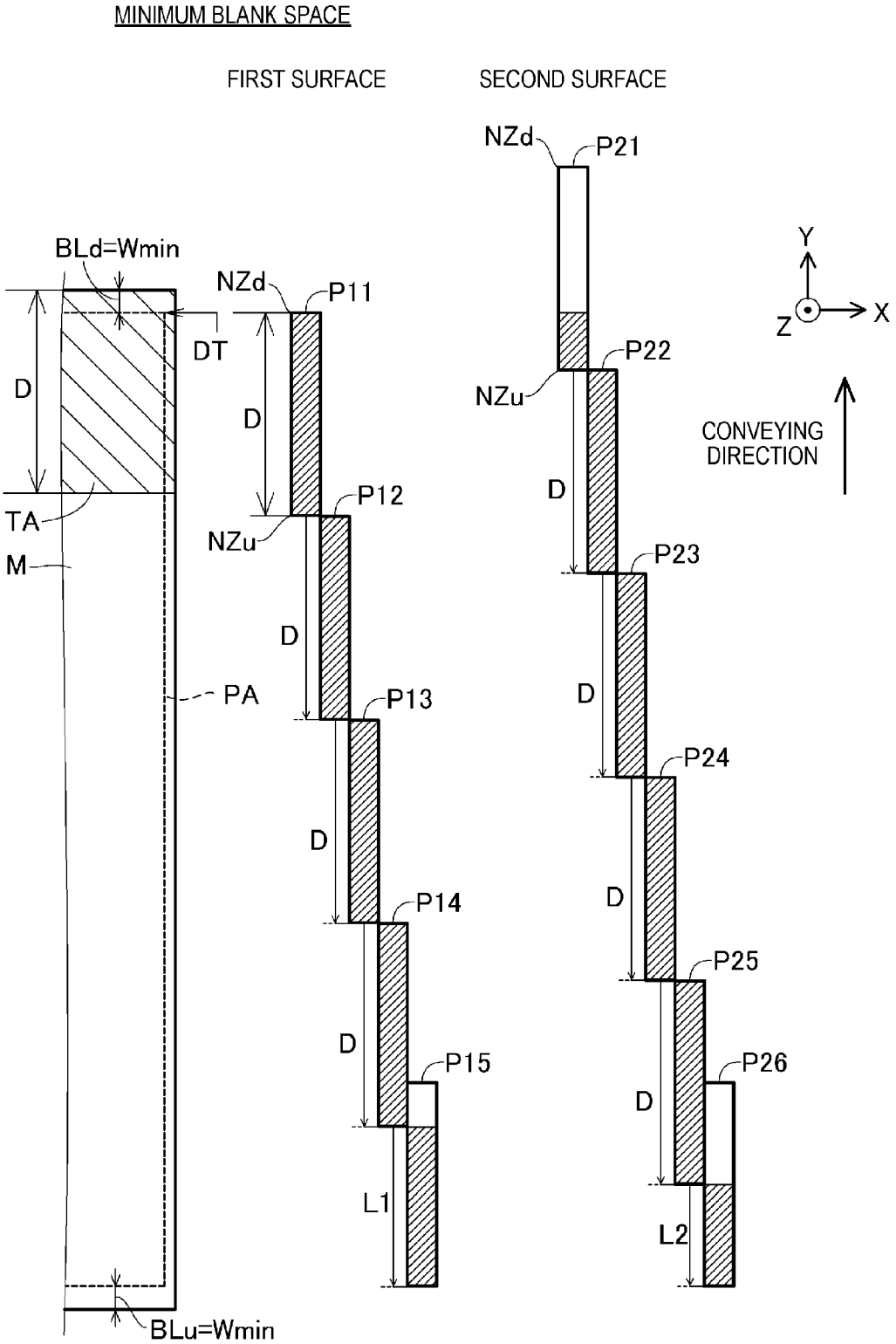
FIG. 4 is a first view depicting a head position with respect to a sheet M for each main scanning processing.

FIG. 4 is a first view depicting a position of the printing head 240 (hereinafter, referred to as 'head position') with respect to the sheet M for each main scanning processing. In FIG. 4, five head positions P11 to P15 corresponding to the main scanning processing of five times of the printing on the first surface and six head positions P21 to P26 corresponding to the main scanning processing of six times of the printing on the second surface are shown. The head positions P11 to P15 and P21 to P26 are positions in the Y direction of the printing head 240 with respect to the sheet M shown at the right of FIG. 4.

A length in the Y direction of a frame indicative of each head position indicates a length in the Y direction of the nozzle formation region NA of the printing head 240, i.e., the nozzle length D. The head position Pmq corresponds to the qth (q: an integer of 1 or greater) main scanning processing of the printing on an nth surface (n: 1 or 2).

A hatched region within a range indicative of each head position in FIG. 4 indicates positions of nozzles (hereinafter, referred to as using nozzles) to be used for printing of the plurality of nozzles NZ (FIG. 2) formed on the printing head 240.

In the printing processing of the illustrative embodiment, the CPU 110 is configured to execute one pass printing of printing one partial image on the sheet M, for example, a partial image of which a width in the conveying direction is the nozzle length D by using only the one-time main scanning processing.

At the left of FIG. 4, a printing region PA in which the first image and the second image are to be printed is shown with the broken line in correspondence to the sheet M. Incidentally, a printing region in which the first image is to be printed on the first surface and a printing region in which the second image is to be printed on the second surface may have different sizes and positions. However, in FIGS. 4 and 5, the printing region in which the first image is to be printed on the first surface and the printing region in which the second image is to be printed on the second surface have the same size, and the positions thereof on the sheet M are also the same. Therefore, in FIGS. 4 and 5, widths BLd, BLu in the conveying direction of blank spaces of the +Y-side and the −Y-side of the first surface and widths BLd, BLu in the conveying direction of blank spaces of the +Y-side and the −Y-side of the second surface are also the same. This is also the same for FIGS. 7 to 12.

FIG. 4 depicts a case where the width BLu of the blank space of the −Y-side end and the width BLd of the blank space of the +Y-side end have a minimum value Wmin (hereinafter, also referred to as 'case of minimum blank space') in a printing (so-called border printing) where blank spaces are left at four ends including an upstream end (−Y-side end) and a downstream end (+Y-side end) of the sheet M.

Figure 5:
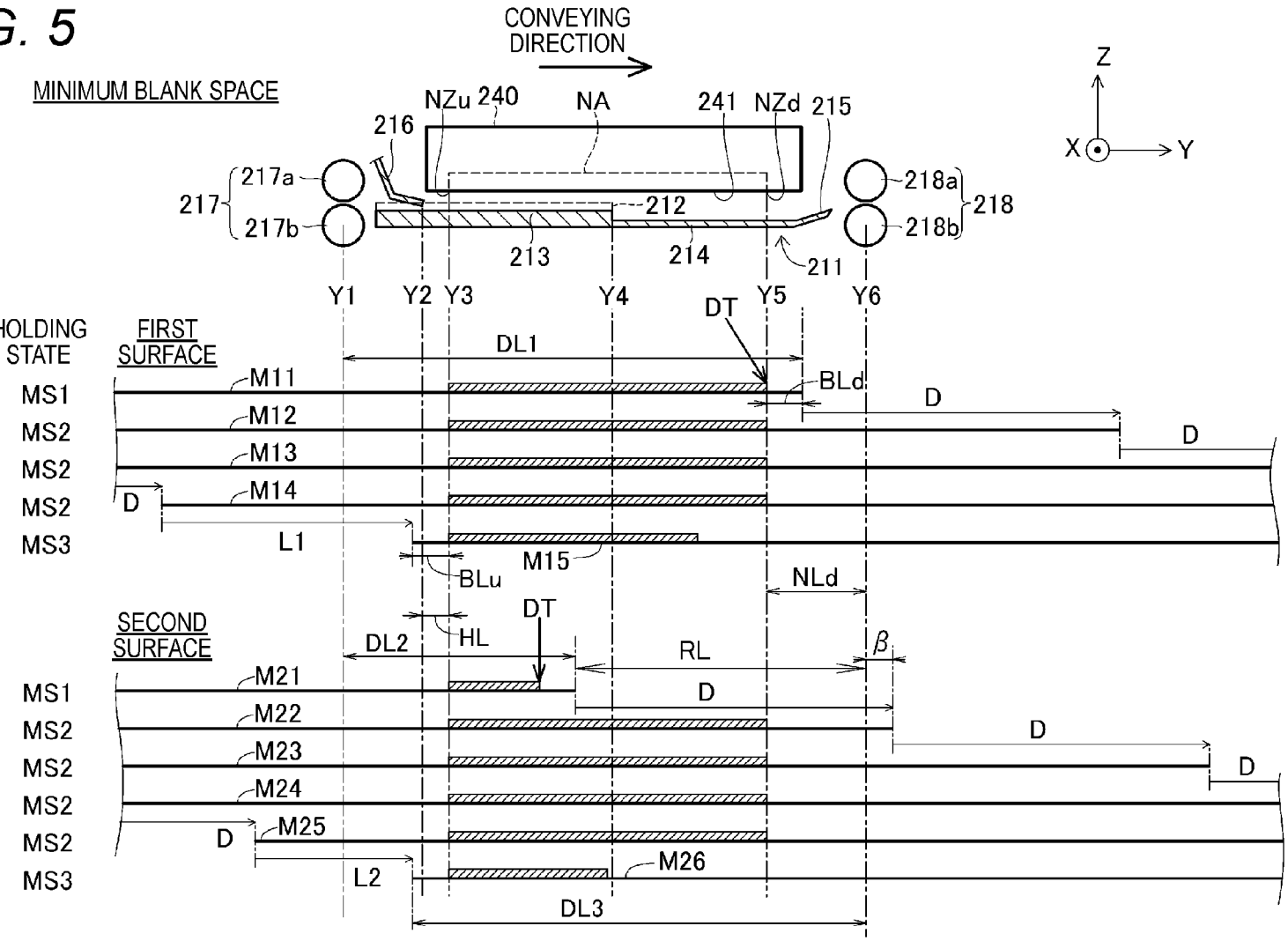
FIG. 5 is a first view depicting a sheet position with respect to the printing head 240 for each main scanning processing.
Figure 6:
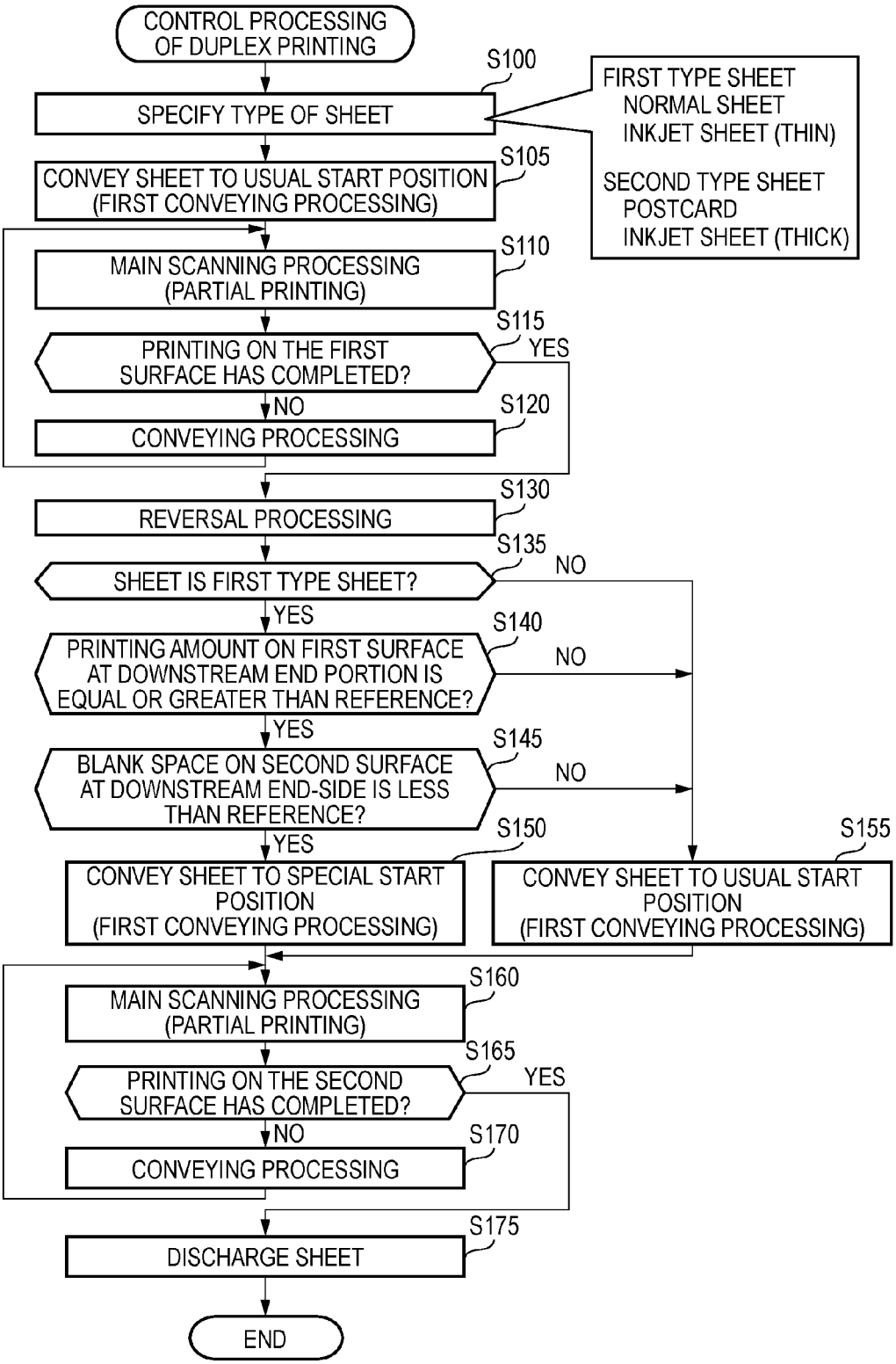
FIG. 6 is a flowchart of control processing of duplex printing.

FIG. 5 is a first view depicting a sheet position with respect to the printing head 240 for each main scanning processing. In FIG. 6, five sheet positions M11 to M15 corresponding to the main scanning processing of five times of the printing on the first surface and six sheet positions M21 to M26 corresponding to the main scanning processing of six times of the printing on the second surface are shown. The sheet position Mmq indicates a position of the sheet M when the qth main scanning processing of the printing on the mth surface is executed. In FIG. 5, a hatched region on the sheet position Mmq indicates a partial printing region on the sheet to be printed by the corresponding main scanning processing. The partial printing region of FIG. 5 corresponds to the positions of the hatched using nozzles.

Incidentally, the first conveying processing is processing of conveying the sheet M to a printing start position, i.e., processing of conveying the sheet M to a sheet position upon execution of the first main scanning processing. The qth (q>2) conveying processing is conveying processing that is to be executed between the (q−1)th main scanning processing and the qth main scanning processing. In FIGS. 4 and 5, conveying amounts (specifically, D, L1, L2) of the second conveying processing and thereafter are shown. As shown in FIG. 4, it can be seen that whenever the conveying processing is executed, the head position is moved in an opposite direction (−Y direction) to the conveying direction with respect to the sheet M. As shown in FIG. 5, it can be seen that whenever the conveying processing is executed, the sheet M is moved in the conveying direction (+Y direction) with respect to the printing head 240.

Positions Y1, Y6 of FIG. 5 are positions in the Y direction at which the sheet is held by the pair of upstream rollers 217 and the pair of downstream rollers 218, respectively. A position Y2 is a position in the Y direction at which the sheet is supported from both surfaces by the plurality of high support members 212 and the plurality of pressing members 216. Also, positions Y3, Y5 are positions in the Y direction of the most upstream nozzle NZu and the most downstream nozzle NZd of the printing head 240, respectively. In the one-time main scanning processing, the printing can be performed within a maximum range from the position Y3 to the position Y5. A position Y4 is positions of the +Y-side ends of the plurality of high support members 212 and the plurality of low support members 213. The position Y4 is located at a substantial center between the position Y3 and the position Y5.

FIG. 6 is a flowchart of the control processing of the duplex printing. In S100 of FIG. 6, the CPU 110 specifies a type of the sheet M. The type of the sheet M is input together with a printing instruction by the user, for example. The CPU 110 specifies a type of the sheet M, based on the user's input. Instead of this configuration, the type of the sheet M may be specified using a sensor provided for the printer 10.

In S105 to S120, the CPU 110 executes the control processing of the printing on the first surface of the sheet M. In the control processing of the printing on the first surface, the conveying processing of the sheet M is carried out with the first surface facing the nozzle formation surface 241 of the printing head 240. In S105, the CPU 110 controls the conveyance mechanism 210 to convey the sheet M to a usual start position. That is, the CPU 110 executes the first conveying processing of the printing on the first surface.

The usual start position is a sheet position M11 of FIG. 5. At the usual start position, the +Y-side end of the first image to be printed on the first surface, i.e., a +Y-side end DT of the printing region PA (FIGS. 4 and 5) coincides with the most downstream nozzle NZd with respect to the positions in the Y direction. In other words, at the sheet position M11, the +Y-side end DT of the printing region PA coincides with the position Y5 in the Y direction. Herein, a distance NLd (FIG. 5) in the Y direction from the position Y5 of the most downstream nozzle NZd to the position Y6 of the pair of downstream rollers 218 is greater than the minimum value Wmin (FIGS. 4 and 5) of the width BLd of the +Y-side blank space. For this reason, at the usual start position of the case of the minimum blank space, the +Y-side end of the sheet M is located at the −Y-side of the position Y6. That is, at the usual start position of the case of the minimum blank space, the sheet M is at a first state MS1 where the sheet is held by the pair of upstream rollers 217, is supported by the pressing members 216 and the support members 212, 213 and is not held by the pair of downstream rollers 218. In other words, at the usual start position, the +Y-side end of the sheet M is located at a position in the Y direction between the pair of upstream rollers 217 and the pair of downstream rollers 218, i.e., at a position in the Y direction between the position Y1 and the position Y6. More specifically, the +Y-side end of the sheet M is located at a position in the Y direction between the position Y5 and the position Y6.

In S110, the CPU 110 executes one-time main scanning processing, thereby executing a partial printing on the first surface of the sheet M located at a current sheet position. For example, just after the first conveying processing, the first main scanning processing is executed. The partial printing that is executed in the first main scanning processing of the printing on the first surface is a first printing that is to be performed on the sheet M at a state where the printing on the first surface thereof has not started yet, i.e., a state where the ink has not been discharged to the first surface yet. Since the sheet M is located at the usual start position, i.e., at the sheet position M11, the partial printing can be performed using all the nozzles in the nozzle length D in the first main scanning processing.

In S115, the CPU 110 determines whether the printing on the first surface has completed. In the example of FIGS. 4 and 5, when the main scanning processing of five times has completed, it is determined that the printing on the first surface has completed. When it is determined that the printing on the first surface has not completed (S115: NO), the CPU 110 executes second conveying processing and thereafter in S120. When the second conveying processing and thereafter is executed, the CPU 110 returns to S110 and executes second main scanning processing and thereafter. When it is determined that the printing on the first surface has completed (S115: YES), the CPU 110 proceeds to S130.

In this way, in the control processing of the printing on the first surface, the conveying processing and the main scanning processing are alternately repeated by the predetermined number of times (for example, five times). As shown in FIG. 4, the conveying amounts of the second to fourth conveying processing are the nozzle length D, respectively, and the conveying amount of the final fifth conveying processing is a conveying amount L1 less than the nozzle length D. In the second to fourth main scanning processing, the partial printing can be performed using all the nozzles in the nozzle length D. In the final fifth main scanning processing, the partial printing is performed using some nozzles of the −Y-side of the plurality of nozzles in the nozzle length D without using some nozzles of the +Y-side.

By the second conveying processing, the +Y-side end of the sheet M is moved to the +Y-side beyond the position Y6 of the pair of downstream rollers 218. For this reason, at the sheet positions M12 to M14 (FIG. 5) during the second to fourth main scanning processing, the sheet M is in a second state MS2 where it is held by the pair of upstream rollers 217, is supported by the pressing members 216 and the support members 212, 213 and is held by the pair of downstream rollers 218.

By the final fifth conveying processing, the −Y-side end of the sheet M is moved from the −Y-side of the position Y1 of the pair of upstream rollers 217 to a position, which is located at the +Y-side of the position Y1 and the −Y-side of the support position Y2 of the pressing members 216 and the support members 212, 213. For this reason, at the sheet position M15 (FIG. 5) during the final fifth main scanning processing, the sheet M is in a third state MS3 where it is not held by the pair of upstream rollers 217, is supported by the pressing members 216 and the support members 212, 213 and is held by the pair of downstream rollers 218. A distance HL (FIG. 5) in the Y direction from the support position Y2 of the pressing members 216 and the support members 212, 213 to the position Y3 of the most upstream nozzle NZu is less than the minimum value Wmin of the width BLu of the −Y-side blank space. For this reason, the printing at the −Y-side end of the first image to be printed on the first surface can be executed in the third state MS3 where a part of the sheet M, which is located at the −Y-side of the printing head 240, is supported by the pressing members 216 and the support members 212, 213.

After the control processing (S105 to S120 in FIG. 5) of the printing on the first surface of the sheet M, the control processing (S135 to S170 in FIG. 6) of the printing on the second surface of the sheet M is executed. In S130 of FIG. 6 between the control processing of the printing on the first surface and the control processing of the printing on the second surface, the CPU 110 controls the reversal mechanism 219 to reverse the sheet M, thereby returning the sheet M onto a conveyance path where the sheet is again conveyed from the −Y-side of the printing head 240 toward the +Y-side. Thereby, in the control processing of the printing on the second surface, the conveying processing of the sheet M is carried out with the second surface facing the nozzle formation surface 241 of the printing head 240.

In S135, the CPU 110 determines whether the sheet M is a first type sheet. The type of the sheet M is specified in S100. As the ink permeates into the sheet M or the ink having permeated in the sheet M is dried, for example, so that the printing surface of the sheet M expands or contracts. For this reason, when the printing is performed on the sheet M, the sheet M may be deformed due to the ink attached to the sheet M during the printing. The deformation of the sheet M varies depending on characteristics of the sheet M such as texture direction, material, thickness and the like of the sheet. For example, the sheet M may be bent to be convex on the printing surface or may be bent to be convex on an opposite surface to the printing surface. The first type sheet is a sheet in which the deformation due to the ink is relatively likely to occur, for example, a sheet that is relatively thin and has low rigidity, such as a normal sheet and a thin inkjet sheet. A second type sheet is a sheet in which the deformation is relatively difficult to occur, for example, a sheet that is relatively thick and has high rigidity, such as a postcard and a thick inkjet sheet.

When it is determined that the sheet M is the first type sheet (S135: YES), the CPU 110 determines in S140 whether a printing amount printed already by the printing on the first surface is equal to or greater than a reference, for a downstream end portion TA of the sheet M during the printing on the second surface. Specifically, with respect to the first surface of the downstream end portion TA (FIG. 4) of the sheet M, the CPU 110 counts the number of dots formed in the control processing (S105 to S120) of the printing on the first surface on the basis of the dot data used in the printing on the first surface. When the first surface of the downstream end portion TA of the sheet M is formed with a predetermined threshold TH1 or greater of dots, it is determined that the printing amount is equal to or greater than the reference. The end portion TA is a portion in the nozzle length D from the +Y-side end of the sheet M during the printing on the second surface, for example.

When it is determined that the printing amount printed already on the +Y-side end portion TA of the sheet M is equal to or greater than the reference (S140: YES), the CPU 110 determines in S145 whether the width BLd of the +Y-side blank space of the second surface of the sheet M is less than a threshold TH2. Specifically, the CPU 110 determines whether a length from the +Y-side end of the sheet M to the +Y-side end of the second image to be printed on the second surface during the printing on the second surface, i.e., the width BLd of the +Y-side blank space is less than the threshold TH2. The threshold TH2 is a value obtained by adding a predetermined margin α (for example, several mm) to the distance NLd (FIG. 5) in the Y direction from the position Y5 of the most downstream nozzle NZd to the position Y6 of the pair of downstream rollers 218. When the width BLd of the +Y-side blank space is equal to or greater than the threshold TH2, the +Y-side end of the second image can be printed in the second state MS2. When the width BLd of the +Y-side blank space is less than the threshold TH2, the +Y-side end of the second image cannot be printed in the second state MS2 and can be printed only in the first state MS1. For example, in the example of FIGS. 4 and 5, since the width BLd of the +Y-side blank space of the second surface is the minimum value Wmin and is shorter than the distance NLd, it is determined that the width BLd of the corresponding blank space is less than the threshold TH2.

When it is determined that the width BLd of the corresponding blank space is less than the threshold TH2 (S145: YES), the CPU 110 conveys the sheet M to a special start position by the conveyance mechanism 210, in S150, as the first conveying processing of the printing on the second surface.

In the case of the minimum blank space, the special start position is the sheet position M21 of FIG. 5. At the special start position, the +Y-side end of the sheet M is located at the +Y-side of the position Y3 of the most upstream nozzle NZu and is also the −Y-side of the position Y5 of the most downstream nozzle NZd. Like this, at the special start position, the +Y-side end of the sheet M is located at the −Y-side of the +Y-side end of the sheet M located at the usual start position, i.e., the sheet position M11 of FIG. 5. As shown in FIG. 5, at the special start position, a distance RL in the Y direction from the +Y-side end of the sheet M to the pair of downstream rollers 218, i.e., a distance RL from the +Y-side end of the sheet M to the position Y6 is shorter than the nozzle length D by a predetermined margin β (for example, several mm). On the other hand, the distance RL in the Y direction to the pair of downstream rollers 218 may be the same as the nozzle length.

Also, at the special start position, the +Y-side end of the sheet M is located at the −Y-side of the position Y4 of the +Y-side ends of the support members 212, 213. That is, at the special start position, the +Y-side end of the sheet M is supported by the support members 212, 213. On the other hand, at the usual start position, the +Y-side end of the sheet M is not supported by the support members 212, 213.

At the special start position, the sheet M is in the first state MS1 where it is held by the pair of upstream rollers 217, is supported by the pressing members 216 and the support members 212, 213 and is not held by the pair of downstream rollers 218, like the usual start position.

Incidentally, at the special start position, a position in the Y direction of the +Y-side end of the second image to be printed on the second surface, i.e., the +Y-side end DT (FIGS. 4 and 5) of the printing region PA is closer to the most upstream nozzle NZu than the central nozzles in the Y direction of the plurality of nozzles in the nozzle length D. More specifically, the +Y-side end DT is located at a substantially central position in the Y direction between the central nozzles in the Y direction and the most upstream nozzles NZu.

In S160, the CPU 110 executes one-time main scanning processing, thereby carrying out the partial printing on the second surface of the sheet M located at the current sheet position. For example, immediately after the first conveying processing, the first main scanning processing is executed. The partial printing that is to be executed in the first main scanning processing of the printing on the second surface is a first printing that is to be executed for the sheet M in a state where the printing on the first surface has completed and the printing on the second surface has not started yet, i.e., a state where the ink has not been discharged to the second surface yet. When the sheet M is located at the special start position, i.e., the sheet position M21, in the first main scanning processing, the partial printing is performed using some nozzles of the −Y-side of the plurality of nozzles in the nozzle length D without using some nozzles of the +Y-side. That is, when the sheet M is located at the special start position, the partial printing cannot be performed using all the nozzles in the nozzle length D, unlike the case where the sheet M is located at the usual start position. For this reason, when the sheet M is located at the special start position, the number of nozzles to be used in the first main scanning processing is smaller than the number of nozzles, which are to be used when the sheet M is located at the usual start position.

In S165, the CPU 110 determines whether the printing on the second surface has completed. In the example of FIG. 4 and FIG. 5, when the main scanning processing of six times has completed, it is determined that the printing on the second surface has completed. When it is determined that the printing on the second surface has not completed (S165: NO), the CPU 110 executes in S170 second conveying processing and thereafter. When the second conveying processing and thereafter is executed, the CPU 110 returns to S160 and executes second main scanning processing and thereafter. When it is determined that the printing on the second surface has completed (S165: YES), the CPU 110 controls the printing mechanism 200 to discharge the sheet M of which both surfaces have been already printed to a discharge tray (not shown) in S175, and ends the control processing of the duplex printing.

In this way, in the control processing of the printing on the second surface, the conveying processing and the main scanning processing are alternately repeated by the predetermined number of times (for example, six times). As shown in FIG. 4, the second to fifth conveying amounts are the nozzle length D, respectively, and the final sixth conveying amount is a conveying amount L2 less than the nozzle length D. The conveying amount L2 is less than the conveying amount L1 in the final fifth conveying processing of the printing on the first surface. In the second to fifth main scanning processing, the partial printing can be performed using all the nozzles in the nozzle length D. In the final sixth main scanning processing, the partial printing is performed using some nozzles of the −Y-side of the plurality of nozzles in the nozzle length D without using some nozzles of the +Y-side. The number of nozzles to be used in the final sixth main scanning processing is smaller than the number of nozzles, which are to be used in the final fifth main scanning processing of the control processing of the printing on the first surface.

By the second conveying processing, the +Y-side end of the sheet M is moved to the +Y-side beyond the position Y6 of the pair of downstream rollers 218. For this reason, at the sheet positions M22 to M24 (FIG. 5) during the second to fifth main scanning processing, the sheet M is in the second state MS2 where it is held by the pair of upstream rollers 217, is supported by the pressing members 216 and the support members 212, 213 and is also held by the pair of downstream rollers 218.

By the final sixth conveying processing, the sheet M is moved to the same position as the sheet position M15 after the final fifth conveying processing in the control processing of the printing on the first surface. That is, at the sheet position M26 (FIG. 5) after the final sixth conveying processing, the sheet M is in the third state MS3 where it is not held by the pair of upstream rollers 217, is supported by the pressing members 216 and the support members 212, 213 and is held by the pair of downstream rollers 218. For this reason, like the printing on the first surface, the printing at the −Y-side end of the second image to be printed on the second surface can be performed at a state where a part of the sheet M positioned at the −Y-side of the printing head 240 is supported by the pressing members 216 and the support members 212, 213.

Returning to FIG. 6, when it is determined that the sheet M is a second type sheet (S135: NO), when it is determined that the printing amount printed already on the +Y-side end portion TA of the sheet M is less than the reference (S140: NO) or when the width BLd of the +Y-side blank space of the second surface of the sheet M is equal to or greater than the threshold TH2 (S145: NO), the CPU 110 conveys the sheet M to the usual start position by the conveyance mechanism 210, in S155, as the first conveying processing of the printing on the second surface. That is, in this case, the first conveying processing (S155) of the printing on the second surface is the same as the first conveying processing (S105) of the printing on the first surface. Also, the first main scanning processing and thereafter and the second conveying processing and thereafter, which are executed in S160 to S170, are executed in the same manner as the printing on the first surface that is executed in S110 to S115. Therefore, in this case, the control processing of the printing on the second surface is the same processing as the control processing of the printing on the first surface.

According to the above control processing of the duplex printing, in the control processing (also referred to as 'first control processing') of the printing on the first surface, the CPU 110 conveys the sheet M to the sheet position M12 by the conveyance mechanism 210 in the first conveying processing and then executes the partial printing on the first surface of the sheet M located at the sheet position M12 by the printing head 240 in the first main scanning processing, thereby starting the printing on the first surface. In the control processing (also referred to as 'second control processing') of the printing on the second surface, the CPU 110 conveys the sheet M to the sheet position M21 by the conveyance mechanism 210 in the first conveying processing and then executes the partial printing on the second surface of the sheet M located at the sheet position M21 by the printing head 240 in the first main scanning processing, thereby starting the printing on the second surface. The +Y-side end of the sheet M located at the sheet position M21 is positioned at the −Y-side of the +Y-side end of the sheet M located at the sheet position M11.

For this reason, during the printing on the second surface, the printing on a region adjacent to the +Y-side end of the sheet M upon the start of printing is performed with the +Y-side end of the sheet M being located at the −Y-side, as compared to the printing on the region during the printing on the first surface. That is, during the printing on the second surface, the printing on the region adjacent to the +Y-side end of the sheet M is performed at the state where the distance from the pair of upstream rollers 217 to the +Y-side end of the sheet M is shorter, as compared to the printing on the first surface. In FIG. 4, it can be seen that the distance DL2 from the pair of upstream rollers 217 at the sheet position M21 to the +Y-side end of the sheet M is shorter than the distance DL1 from the pair of upstream rollers 217 at the sheet position M11 to the +Y-side end of the sheet M. In the example of FIG. 4, the distance DL2 is a half or less of the distance DL1.

Herein, when the sheet M is in the first state MS1, it can be said that the distances DL1, DL2 are the length in the Y direction of the part of the sheet M, which protrudes from the pair of upstream rollers 217 in the +Y direction. The sheet M is more likely to be deformed, depending on the gravity, types of the sheet, mounting environments of the printer and the like, when the distances DL1, DL2 become longer. In particular, the +Y-side end of the sheet M is more likely to move in the Z direction when the distances DL1, DL2 become longer. Therefore, as the distances DL1, DL2 becomes longer, a rate of defect occurrence that the nozzle formation surface 241 is contacted to the sheet M and the sheet M is thus dirtied by the ink increases. Also, as the distances DL1, DL2 become longer, the distance between the sheet M and the nozzle formation surface 241 easily varies. Therefore, landing positions of the dots deviate, so that a rate of defect occurrence that an image quality of an image to be printed is deteriorated increases.

Upon the printing on the second surface, the first image has been already printed on the first surface of the sheet M. For this reason, during the printing on the second surface, the sheet M is likely to be deformed due to the inks attached to the sheet M during the printing on the first surface. According to the illustrative embodiment, during the printing on the second surface, as described above, the distance DL2 is relatively short. Therefore, when performing the printing on the second surface in the vicinity of the +Y-side end (downstream end) of the sheet M, it is possible to suppress the deformation of the sheet M, which is to be caused due to the inks attached to the sheet M during the printing on the first surface. Therefore, it is possible to reduce a situation where the defect is caused due to the deformation of the sheet M and the printing quality adjacent to the +Y-side end of the sheet M is deteriorated.

Incidentally, during the printing on the first surface, since the printing is not performed on the second surface of the sheet M, before the first conveying processing and the first main scanning processing, the ink is not attached to the sheet M. For this reason, during the printing on the first surface, even when the distance DL1 is long, the deformation possibility of the sheet M is relatively low. According to the illustrative embodiment, during the printing on the first surface, since the distance DL1 is relatively long, it is possible to increase an amount of the printing in the vicinity of the +Y-side end of the sheet M, which is performed in the first main scanning processing.

As can be seen from the above descriptions, according to the illustrative embodiment, it is possible to implement the appropriate duplex printing capable of reducing the deterioration of the printing quality and suppressing the increase in the printing time. In the illustrative embodiment, it is possible to reduce the deterioration of the printing quality, as compared to a configuration where the control processing for performing the printing on the first surface is applied to the duplex printing, too. Also, in the illustrative embodiment, it is possible to suppress the increase in the printing time, as compared to a configuration where the control processing for performing the printing on the second surface is applied to the duplex printing, too.

In the example of FIGS. 4 and 5, the number of times (five times, in the example of FIGS. 4 and 5) of one set of processing including the conveying processing and the main scanning processing, which are to be executed during the printing on the first surface, is less than the number of times (six times, in the example of FIGS. 4 and 5) of one set of processing that is to be executed during the printing on the second surface. In other words, the first control processing includes the one set of processing of K1 times (K1: an integer of 2 or greater), which includes the conveyance of the sheet M by the conveyance mechanism 210 and the partial printing by the printing head 240. The second control processing includes the one set of processing of K2 times (K2: an integer greater than K1). Like this, it can be seen that it is possible to appropriately suppress the increase in the printing time on the first surface and the increase in the entire printing time of the duplex printing.

Also, as shown in FIG. 4, in the first main scanning processing of the printing on the first surface, the partial printing can be performed using all the nozzles in the nozzle length D. However, in the first main scanning processing of the printing on the second surface, the partial printing is performed using only some nozzles of the −Y-side. That is, in the control processing of the printing on the first surface, the partial printing is performed on the first surface of the sheet M located at the sheet position M11 by using the first nozzles of the plurality of nozzles and the second nozzles located at the +Y-side of the first nozzles, and in the control processing of the printing on the second surface, the partial printing is performed on the second surface of the sheet M located at the sheet position M21 by using the first nozzles, without using the second nozzles. As a result, the printing amount by the first main scanning processing of the printing on the first surface can be made greater than the printing amount by the first main scanning processing of the printing on the second surface. When the printing amount by the first main scanning processing of the printing on the first surface is reduced, the printing time may increase. When the printing amount by the first main scanning processing of the printing on the second surface increases, an image having a relatively high possibility that the image quality will be reduced due to the deformation of the sheet M may be printed in a relatively wide region. Also, when the printing amount by the first main scanning processing of the printing on the second surface increases, an amount of the ink to be attached in the vicinity of the +Y-side end of the sheet increases, so that the deformation of the sheet M may be promoted. When the deformation of the sheet M is promoted, the +Y-side end of the sheet M may not be held by the pair of downstream rollers 218 in the second conveying processing, for example, so that a jamming may occur or the conveyance accuracy of the sheet M may be deteriorated. However, according to the illustrative embodiment, the above problems are suppressed, so that it is possible to appropriately perform the printing in the vicinity of the ends of the sheet on the first surface and the second surface of the sheet M.

Also, as shown in FIG. 4, in the first main scanning processing of the printing on the first surface, the partial printing is performed using the nozzles of first number (for example, all the nozzles in the nozzle length D), and in the first main scanning processing of the printing on the second surface, the partial printing is performed using the nozzles of second number less than the first nozzle (for example, some nozzles of the −Y-side). In other words, in the first control processing, the CPU 110 is configured to execute the partial printing on the first surface of the sheet M located at the sheet position M11 by using the N1 nozzles (N1: an integer of 2 or greater) of the plurality of nozzles NZ of the printing head 240. In the second control processing, the CPU 110 is configured to execute the partial printing on the second surface of the sheet M located at the sheet position M21 by using the N2 nozzles (N2: an integer of 1 or greater and less than N1) of the plurality of nozzles NZ of the printing head 240. As a result, the printing amount by the first main scanning processing of the printing on the first surface can be made greater than the printing amount by the first main scanning processing of the printing on the second surface. Therefore, as described above, it is possible to appropriately perform the printing in the vicinity of the ends of the sheet on the first surface and the second surface of the sheet M.

Further, according to the illustrative embodiment, the sheet position M21 is set so that the distance RL (FIG. 5) in the conveying direction from the +Y-side end of the sheet M to the pair of downstream rollers 218 is equal to or less than the nozzle length D, more preferably, is shorter than the nozzle length D by the margin β. As a result, when the sheet M is conveyed by the nozzle length D through the second conveying processing, the sheet M can be held by the pair of downstream rollers 218. That is, in the second state MS2 where it is possible to suppress the deformation of the sheet M, as compared to the first state MS1, it is possible to secure the second main scanning processing. Therefore, it is possible to more effectively reduce the deterioration of the printing quality, which is to be caused due to the deformation of the sheet M.

Further, according to the illustrative embodiment, both the control processing of the printing on the first surface and the control processing of the printing on the second surface include the processing (for example, the second to fourth conveying processing of each control processing) of conveying the sheet by the nozzle length D. As a result, in at least some of the main scanning processing, it is possible to perform the partial printing by using the nozzles of maximum number, so that it is possible to suppress the lowering of the printing speed. More specifically, in the illustrative embodiment, in any of the control processing of the printing on the first surface and the control processing of the printing on the second surface, the sheet is conveyed by the nozzle length D in all the conveying processing except for the first conveying processing and the final conveying processing. As a result, in the control processing of the printing on the first surface, the partial printing can be performed using the nozzles of maximum number in the first to fourth main scanning processing, and in the control processing of the printing on the second surface, the partial printing can be performed using the nozzles of maximum number in the second to fifth main scanning processing. Therefore, it is possible to more effectively suppress the lowering of the printing speed. Also, in the relatively high-speed duplex printing including the processing of conveying the sheet by the nozzle length D, i.e., the duplex printing of one pass printing, it is possible to suppress the increase in the printing time and to reduce the deterioration of the printing quality.

Further, the printing mechanism 200 of the illustrative embodiment has the pressing members 216 and the support members 212, 213 configured to support the sheet M with deforming the sheet in a waveform along the direction intersecting with the Y direction. Therefore, even when the sheet is in the first state MS1, it is possible to suppress the +Y-side end of the sheet from hanging down or floating. As a result, it is possible to more effectively reduce the deterioration of the printing quality in the vicinity of the +Y-side end of the sheet.

Further, in the illustrative embodiment, the +Y-side end of the sheet M located at the sheet position M21 is positioned at the −Y-side of the position Y4 of the +Y-side ends of the support members 212, 213. As a result, the +Y-side end of the sheet M located at the sheet position M21 is supported by the support members 212, 213 from the opposite surface-side to the printing surface. Therefore, the sheet M located at the sheet position M21 is in the first state MS1 but the deformation of the +Y-side end of the sheet M is suppressed through the support by the support members 212, 213. As a result, it is possible to more effectively reduce the deterioration of the printing quality in the vicinity of the +Y-side end of the sheet.

Further, in the illustrative embodiment, when the sheet M is the first type sheet (S135 in FIG. 6: YES), the first main scanning processing, i.e., the first partial printing is executed for the second surface of the sheet M located at the special start position, i.e., the sheet position M21. When the sheet M is the second type sheet (S135 of FIG. 6: NO), the first main scanning processing is executed for the second surface of the sheet M located at the usual start position, i.e., the sheet position M11. As a result, the appropriate duplex printing is implemented depending on the types of the sheet. For example, in the duplex printing for a sheet that is difficult to be deformed, it is possible to further shorten the printing time, and in the duplex printing for a sheet that is likely to be deformed, it is possible to suppress the increase in the printing time and to reduce the deterioration of the printing quality.

Further, in the illustrative embodiment, when it is determined for the +Y-side end portion TA of the sheet M during the printing on the second surface that the printing amount printed already during the printing on the first surface is equal to or greater than the reference (S140 in FIG. 6: YES), the first main scanning processing, i.e., the first partial printing is performed on the second surface of the sheet M located at the special start position, i.e., the sheet position M21. When it is determined for the +Y-side end portion TA of the sheet M during the printing on the second surface that the printing amount printed already during the printing on the first surface is equal to or greater than the reference (S140 in FIG. 6: NO), the first main scanning processing is executed for the second surface of the sheet M located at the usual start position, i.e., the sheet position M11. As a result, it is possible to appropriately control the printing on the second surface in accordance with the printing amount printed already on the +Y-side end portion TA of the sheet M. For example, during the printing on the second surface, when the +Y-side end portion TA of the sheet M is difficult to be deformed, specifically, when the printing amount printed already on the first surface of the end portion TA is relatively small, it is possible to further shorten the printing time. During the printing on the second surface, when the +Y-side end portion TA of the sheet M is likely to be deformed, specifically, when the printing amount printed already on the first surface of the end portion TA is relatively large, it is possible to reduce the deterioration of the printing quality on the second surface.

Further, according to the illustrative embodiment, the control processing of the printing on the first surface includes the fifth conveying processing of conveying the sheet M to the sheet position M15 and the fifth main scanning processing of executing the partial printing on the first surface of the sheet M located at the sheet position M15. Also, the control processing of the printing on the second surface includes the sixth conveying processing of conveying the sheet M to the same sheet position M26 as the sheet position M15 and the sixth main scanning processing of executing the partial printing on the second surface of the sheet M located at the sheet position M26. That is, in both the control processing, the final main scanning processing of performing the printing in the vicinity of the −Y-side end of the sheet M, i.e., the final partial printing is executed for the sheet M located at the same sheet position.

At the sheet positions M15, M26, the part of the sheet M located at the −Y-side of the printing head 240 is not held by the pair of upstream rollers 217 but is supported from both sides by the pressing members 216 and the support members 212, 213. For this reason, at the sheet positions M15, M26, the distance DL3 (FIG. 4) from the pair of downstream rollers 218 to the −Y-side end of the sheet M is relatively long but the deformation in the vicinity of the −Y-side end of the sheet M is suppressed. As a result, even when the −Y-side end of the sheet M is printed during the printing on the second surface at the same sheet position during the printing on the first surface, it is possible to suppress the increase in the printing time without deteriorating the printing quality in the vicinity of the −Y-side of the sheet.

Figure 7:
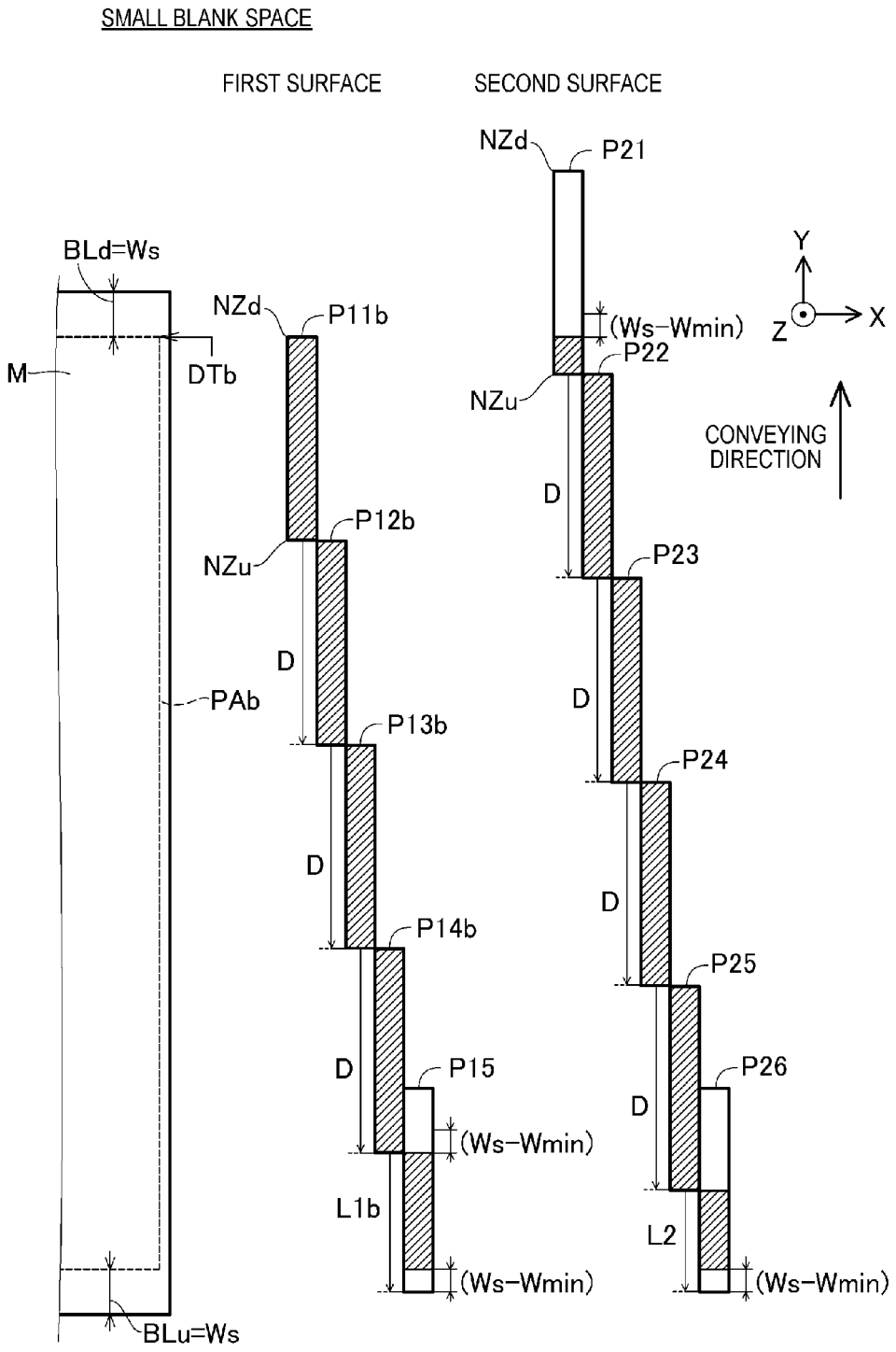
FIG. 7 is a second view depicting the head position with respect to the sheet M for each main scanning processing.

Subsequently, a case (hereinafter, referred to as 'case of a small blank space') where the width BLd of the +Y-side blank space and the width BLu of the −Y-side blank space of the sheet M have a value Ws greater than the minimum value Wmin and smaller than a distance NLd (FIG. 8) in the Y direction from the position Y5 of the most downstream nozzle NZd to the position Y6 of the pair of downstream rollers 218 is described with reference to FIGS. 7 and 8. FIG. 7 is a second view depicting the head position with respect to the sheet M for each main scanning processing. In FIG. 7, five head positions P11*b* to P14*b*, P15 corresponding to the main scanning processing of five times of the printing on the first surface and six head positions P21 to P26 corresponding to the main scanning processing of six times of the printing on the second surface are shown. At the right of FIG. 7, a printing region PAb in which the first image and the second image of which the widths BLd, BLu of the blank spaces are the value Ws are to be printed is shown in correspondence to the sheet M.

Figure 8:
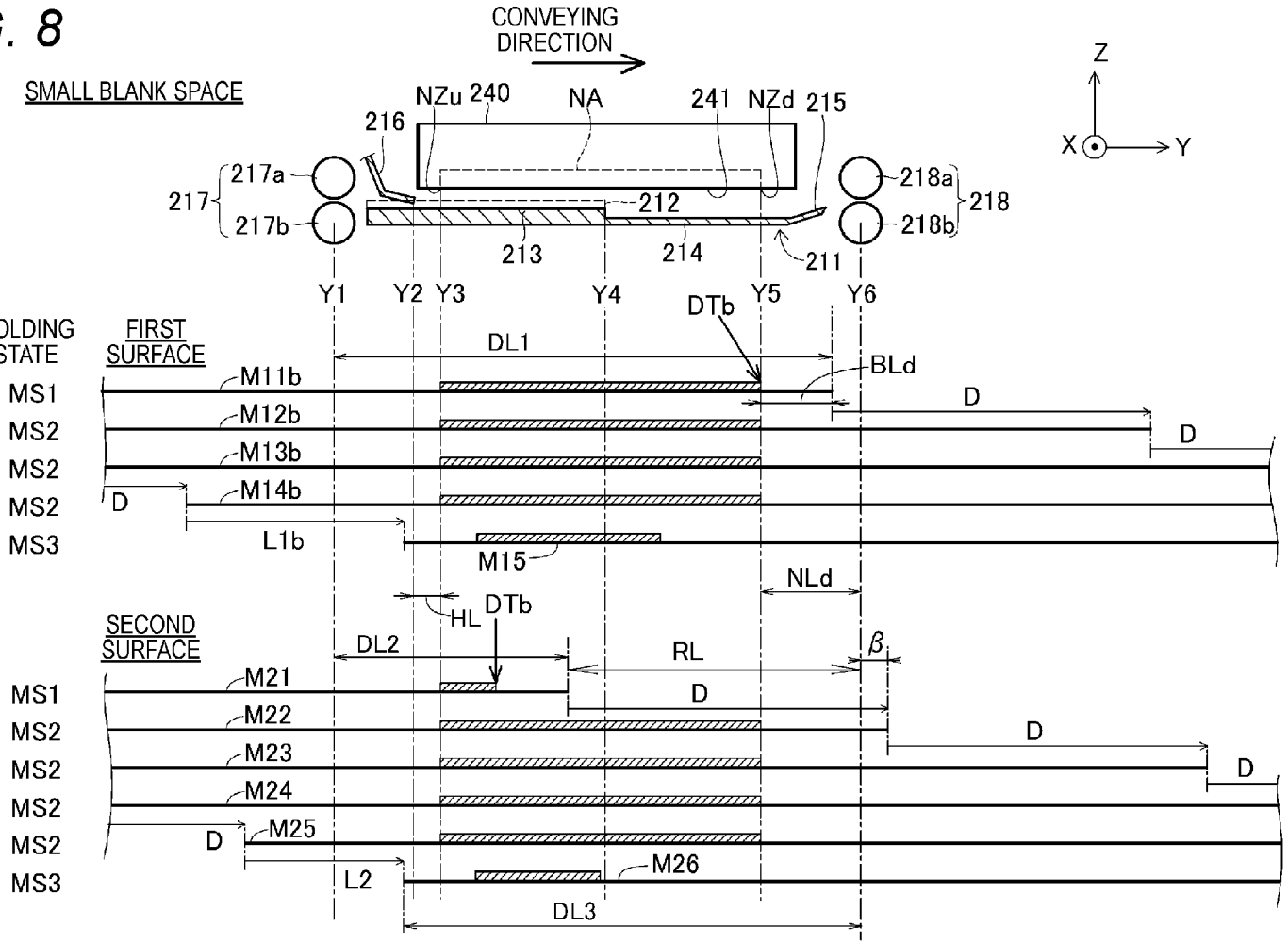
FIG. 8 is a second view depicting the sheet position with respect to the printing head 240 for each main scanning processing.

FIG. 8 is a second view depicting the sheet position with respect to the printing head 240 for each main scanning processing. In FIG. 8, five sheet positions M11*b* to M15*b* corresponding to the main scanning processing of five times of the printing on the first surface and six sheet positions M21 to M26 corresponding to the main scanning processing of six times of the printing on the second surface are shown.

In the case of the small blank space, the control processing of the printing on the first surface is described. The sheet position M11*b* (FIG. 8) after the first conveying processing is the usual start position. At the sheet position M11*b*, the +Y-side end of the first image, i.e., the +Y-side end DTb (FIGS. 7 and 8) of the printing region PAb and the most downstream nozzle NZd coincide with each other with respect to the positions in the Y direction. In other words, at the sheet position M11*b*, the +Y-side end DTb of the printing region PAb coincides with the position Y5 in the Y direction. In the case of the small blank space, the widths BLd, BLu of the blank spaces are greater, as compared to the case of the minimum blank space shown in FIGS. 4 and 5. That is, the +Y-side end DTb of the printing region PAb of the sheet M is located at the −Y-side of the +Y-side end DT of the case of the minimum blank space (FIG. 7). For this reason, the sheet position M11*b* is shifted to the +Y-side of the sheet position M11 of FIG. 5 by a width difference (Ws-Wmin) of the blank spaces.

The sheet positions M12*b* to M14*b* after the second to fourth conveying processing are shifted to the +Y-side of the sheet positions M12 to M14 shown in FIG. 5 by the width difference (Ws-Wmin), like the sheet position M11*b*. The sheet position M15 after the final fifth conveying processing is the same position as the sheet position M15 shown in FIG. 5. For this reason, in FIG. 7, the sheet position M15 is denoted with the same reference numeral as FIG. 5.

The head positions P11*b* to P14*b*, P15 of FIG. 7 correspond to the sheet positions M11*b* to M14*b*, M15 of FIG. 8, respectively. Since the head position P15 is the same position as the head position P15 of FIG. 4, it is denoted with the same reference numeral as FIG. 4.

The conveying amounts of the second to fourth conveying processing are the nozzle length D, respectively, like the case of the minimum blank space. A conveying amount L1*b* of the fifth conveying processing is shorter than the conveying amount L1 (FIG. 4) of the case of the minimum blank space by the width difference (Ws-Wmin).

In the case of the small blank space, the number of nozzles to be used in the fifth main scanning processing at the head position P15 is smaller than that of the case of the minimum blank space by a value 2×(Ws−Wmin). The reason is that the widths of the +Y-side and −Y-side blank spaces are greater by the width difference (Ws-Wmin), respectively. Specifically, in the fifth main scanning processing of the case of the small blank space, as hatched in the head position P15 of FIG. 7, the number of nozzles to be used is less at both ends of the +Y-side and the −Y-side by the width difference (Ws-Wmin).

During the control of the printing on the first surface, even in the case of the small blank space, since all the nozzles in the nozzle length D are used in all the main scanning processing except for the final main scanning processing, like the case of the minimum blank space, it is possible to suppress the increase in the printing time.

In the case of the small blank space, the control processing of the printing on the second surface is described. In FIG. 7, the head positions P21 to P26 in the first to sixth main scanning processing are the same positions as the head positions P21 to P26 of FIG. 4, so that they are denoted with the same reference numerals as FIG. 4. Likewise, in FIG. 8, the sheet positions M21 to M26 after the first to sixth conveying processing are the same positions as the sheet positions M21 to M26 of FIG. 5, so that they are denoted with the same reference numerals as FIG. 5. However, in the case of the small blank space, the number of nozzles to be used in the first main scanning processing and the final sixth main scanning processing are less by the width difference (Ws-Wmin), as compared to the case of the minimum blank space. As hatched in the head positions P21, P26 of FIG. 7, in the case of the small blank space of FIG. 7, the nozzles of the +Y-side corresponding to the width difference (Ws-Wmin) are not used at the head position P21, as compared to the case of the minimum blank space of FIG. 4. Also, in the case of the small blank space of FIG. 7, the nozzles of the −Y-side corresponding to the width difference (Ws-Wmin) are not used at the head position P26, as compared to the case of the minimum blank space of FIG. 4.

As can be seen from the above description, regarding the printing on the second surface of the sheet M, when the +Y-side blank space of the sheet M has a first width (for example, Wmin), the partial printing is performed on the second surface of the sheet M located at the sheet position M21 by using the nozzles of a third number. Regarding the printing on the second surface of the sheet M, when the +Y-side blank space of the sheet M has a second width (for example, Ws) greater than the first width, the partial printing is performed on the second surface of the sheet M located at the sheet position M21 by using the nozzles of a fourth number less than the third number. In other words, in the second control processing, when the +Y-side blank space of the sheet M has the first width, the CPU 110 executes the partial printing on the second surface of the sheet M located at the sheet position M21 by using the N3 nozzles (N3: an integer of 2 or greater) of the plurality of nozzles NZ of the printing head 240. In the second control processing, when the +Y-side blank space of the sheet M has the second width greater than the first width, the CPU 110 executes the partial printing on the second surface of the sheet M located at the sheet position M21 by using the N4 nozzles (N4: an integer of 1 or greater and less than N3) of the plurality of nozzles NZ. As a result, it is possible to appropriately perform the printing in the vicinity of the +Y-side end of the sheet M in accordance with the blank space of the second image to be printed.

Figure 9:
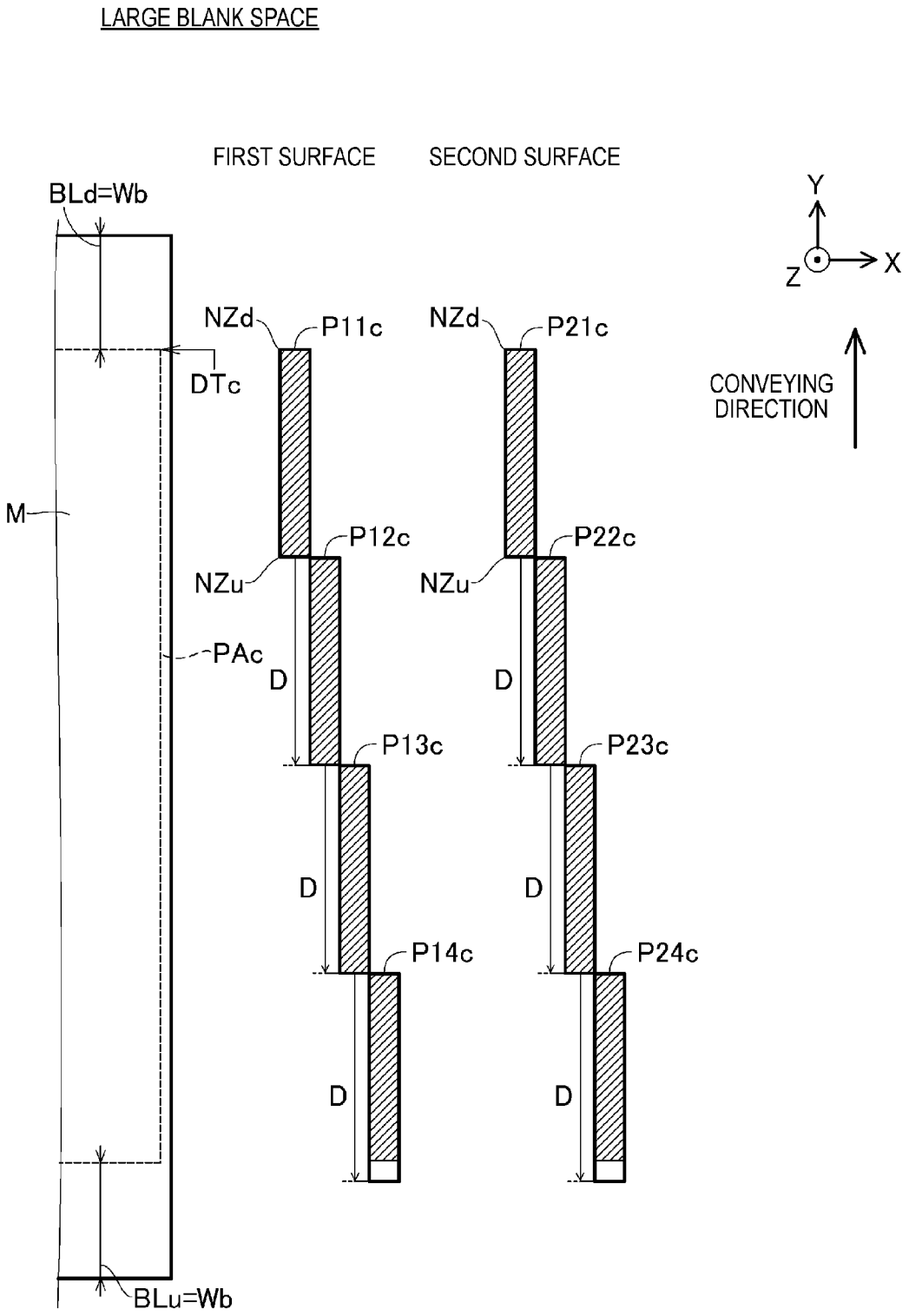
FIG. 9 is a third view depicting the head position with respect to the sheet M for each main scanning processing.

Subsequently, a case (hereinafter, referred to as 'case of a large blank space') where the width BLd of the +Y-side blank space and the width BLu of the −Y-side blank space of the sheet M have a value Wb greater than the distance NLd (FIG. 10) in the Y direction from the position Y5 of the most downstream nozzle NZd to the position Y6 of the pair of downstream rollers 218 is described with reference to FIGS. 9 and 10. FIG. 9 is a third view depicting the head position with respect to the sheet M for each main scanning processing. In FIG. 9, four head positions P11*c* to P14*c* corresponding to the main scanning processing of four times of the printing on the first surface and four head positions P21*c* to P26*c* corresponding to the main scanning processing of four times of the printing on the second surface are shown. At the right of FIG. 9, a printing region PAc in which the first image and the second image of which the widths BLd, BLu of the blank spaces are the value Wb are to be printed is shown in correspondence to the sheet M.

Figure 10:
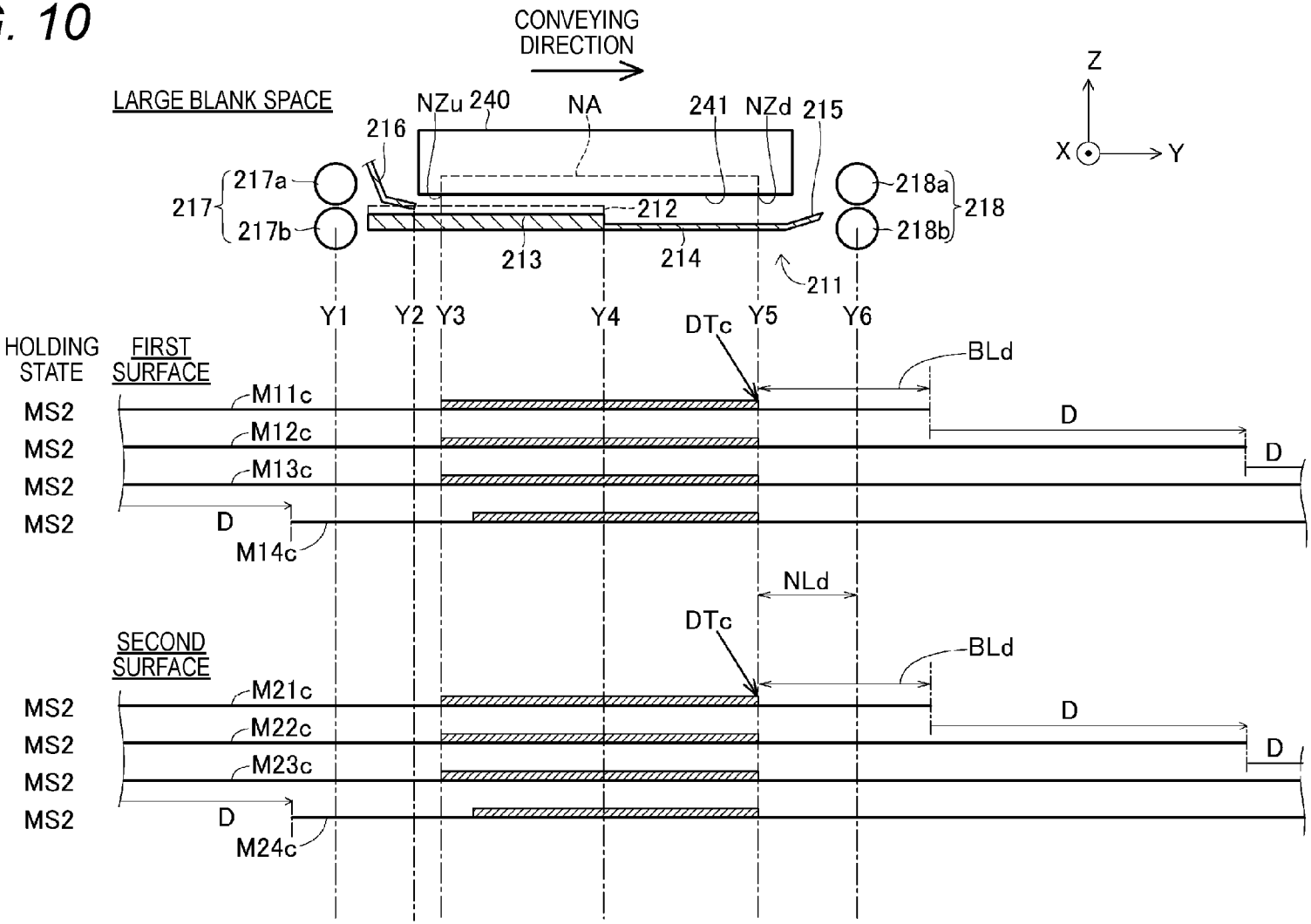
FIG. 10 is a third view depicting the sheet position with respect to the printing head 240 for each main scanning processing.

FIG. 10 is a third view depicting the sheet position with respect to the printing head 240 for each main scanning processing. In FIG. 10, four sheet positions M11*c* to M14*c* corresponding to the main scanning processing of four times of the printing on the first surface and four sheet positions M21*c* to M24*c* corresponding to the main scanning processing of four times of the printing on the second surface are shown.

In the case of the large blank space, the control processing of the printing on the first surface is described. The sheet position M11*c* (FIG. 10) after the first conveying processing is the usual start position. At the sheet position M11*c*, the +Y-side end of the first image, i.e., the +Y-side end DTc (FIGS. 9 and 10) of the printing region PAc and the most downstream nozzle NZd coincide with each other with respect to the positions in the Y direction. In other words, at the sheet position M11*c*, the +Y-side end DTc of the printing region PAc coincides with the position Y5 in the Y direction. In the case of the large blank space, the widths BLd, BLu of the blank spaces are greater, as compared to the case of the minimum blank space shown in FIGS. 4 and 5. That is, the +Y-side end DTc of the printing region PAc of the sheet M is located at the −Y-side of the +Y-side end DT of the case of the minimum blank space (FIG. 9). For this reason, the sheet position M11*c* is shifted to the +Y-side of the sheet position M11 of FIG. 5 by a width difference (Wb-Wmin) of the blank spaces. In the case of the large blank space, the width BLd of the +Y-side blank space of the first surface of the sheet M is greater than the distance NLd, as described above. Therefore, at the sheet position M11*c*, the sheet M is in the second state MS2 where it is held by the pair of upstream rollers 217, is supported by the pressing members 216 and the support members 212, 213 and is held by the pair of downstream rollers 218, even though the sheet is located at the corresponding sheet position after the first conveying processing.

The sheet positions M12*c* to M14*c* after the second to fourth conveying processing are shifted to the +Y-side of the sheet positions M12 to M14 shown in FIG. 5 by the width difference (Wb-Wmin), like the sheet position M11*c*. At the sheet position M14*c* after the final fourth conveying processing, the sheet M is in the second state MS2. That is, in the case of the large blank space, since the width BLu of the −Y-side blank space is greater than the distance NLd, it is possible to perform the printing at the −Y-side end of the first image, which is to be printed on the first surface of the sheet M, in the second state MS2.

The head positions P11*c* to P14*c* of FIG. 9 correspond to the sheet positions M11*c* to M14*c* of FIG. 10, respectively.

The conveying amounts in the second to fourth conveying processing are all the nozzle length D. During the printing on the first surface, even in the case of the large blank space, since all the nozzles in the nozzle length D are used in all the main scanning processing except for the final main scanning processing, like the case of the minimum blank space or the small blank space, it is possible to suppress the increase in the printing time.

In the case of the large blank space, the control processing of the printing on the second surface is described. In the case of the large blank space, it is determined in S145 of FIG. 6 that the width BLd of the +Y-side blank space of the second surface of the sheet M is equal to or greater than the threshold TH2. For this reason, in the case of the large blank space, the sheet M is conveyed to the usual start position in S155, as the first conveying processing. For this reason, in the case of the large blank space, the control processing of the printing on the second surface is the same as the control processing of the printing on the first surface. As can be seen from FIGS. 9 and 10, the sheet positions M11*c* to M14*c* and the sheet position M21*c* to M24*c* are the same, and the head positions P11*c* to P14*c* and the head positions P21*c* to P24*c* are the same.

As can be seen from the above description, in the case of the large blank space, in both the printing on the first surface and the printing on the second surface, all the main scanning processing can be executed in the second state MS2 where the sheet M is difficult to be deformed. For this reason, the conveying amounts of all the conveying processing are set to the nozzle length D. As a result, it is possible to suppress the increase in the printing time. Also, the image quality of the printed image is not deteriorated.

Figure 11:
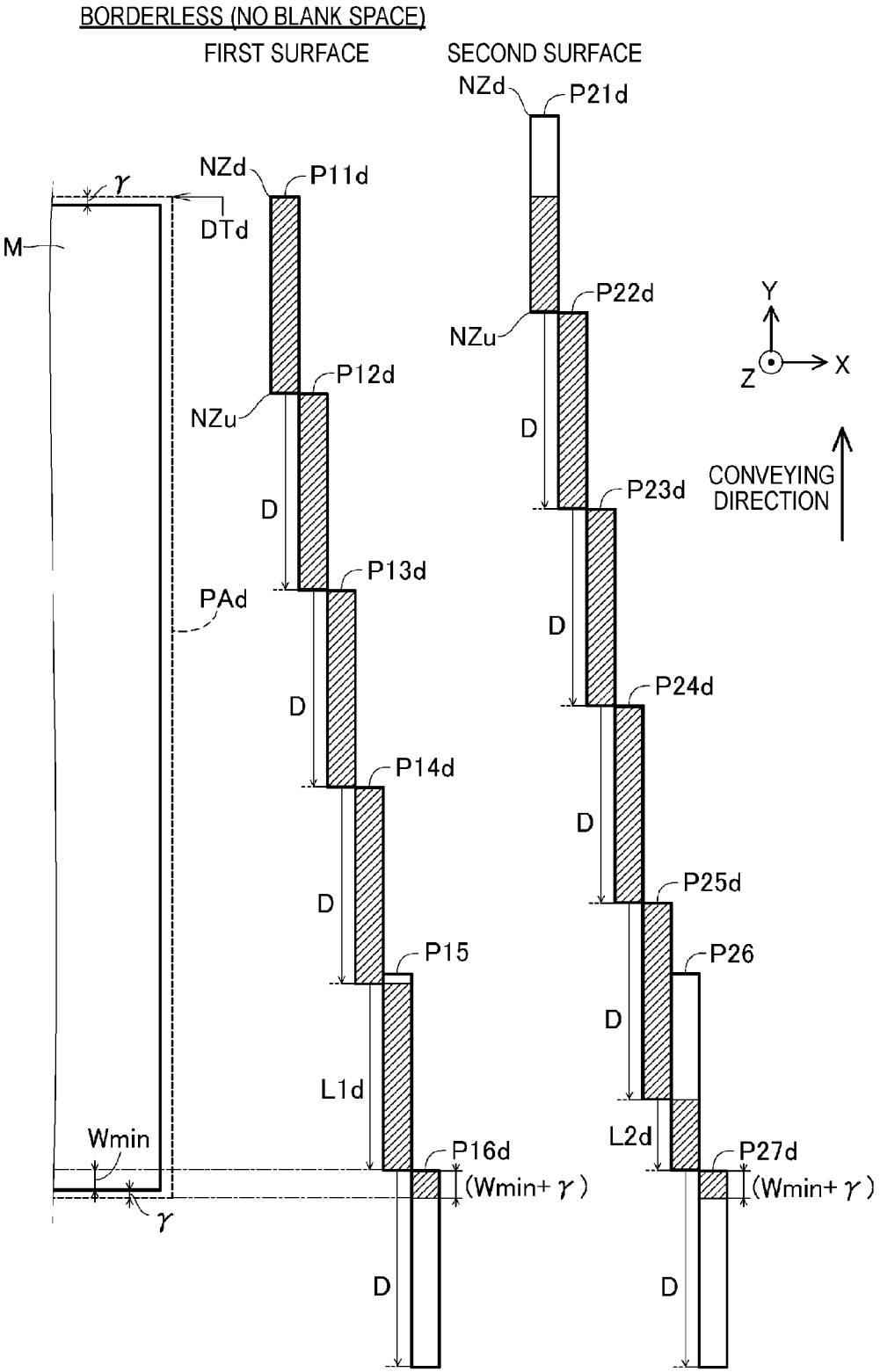
FIG. 11 is a fourth view depicting the head position with respect to the sheet M for each main scanning processing.

Subsequently, a borderless printing where the printing can be performed up to four ends of the sheet M so that a blank space is not left at the four ends of the sheet M is described with reference to FIGS. 11 and 12. FIG. 11 is a fourth view depicting the head position with respect to the sheet M for each main scanning processing. In FIG. 11, six head positions P11*d* to P14*d*, P15, P16*d* corresponding to the main scanning processing of six times of the printing on the first surface and seven head positions P21*d* to P25*d*, P26, P27*d* corresponding to the main scanning processing of seven times of the printing on the second surface are shown. At the right of FIG. 11, a printing region PAd in which the first image and the second image are to be printed during the borderless printing is shown in correspondence to the sheet M. In the borderless printing, the printing region Pad is a region slightly greater than a size of the sheet M so that a blank space is not left, and ends of four directions of the printing region Pad are positioned outside the corresponding ends of the sheet M by a slight margin γ (for example, 2 mm).

Figure 12:
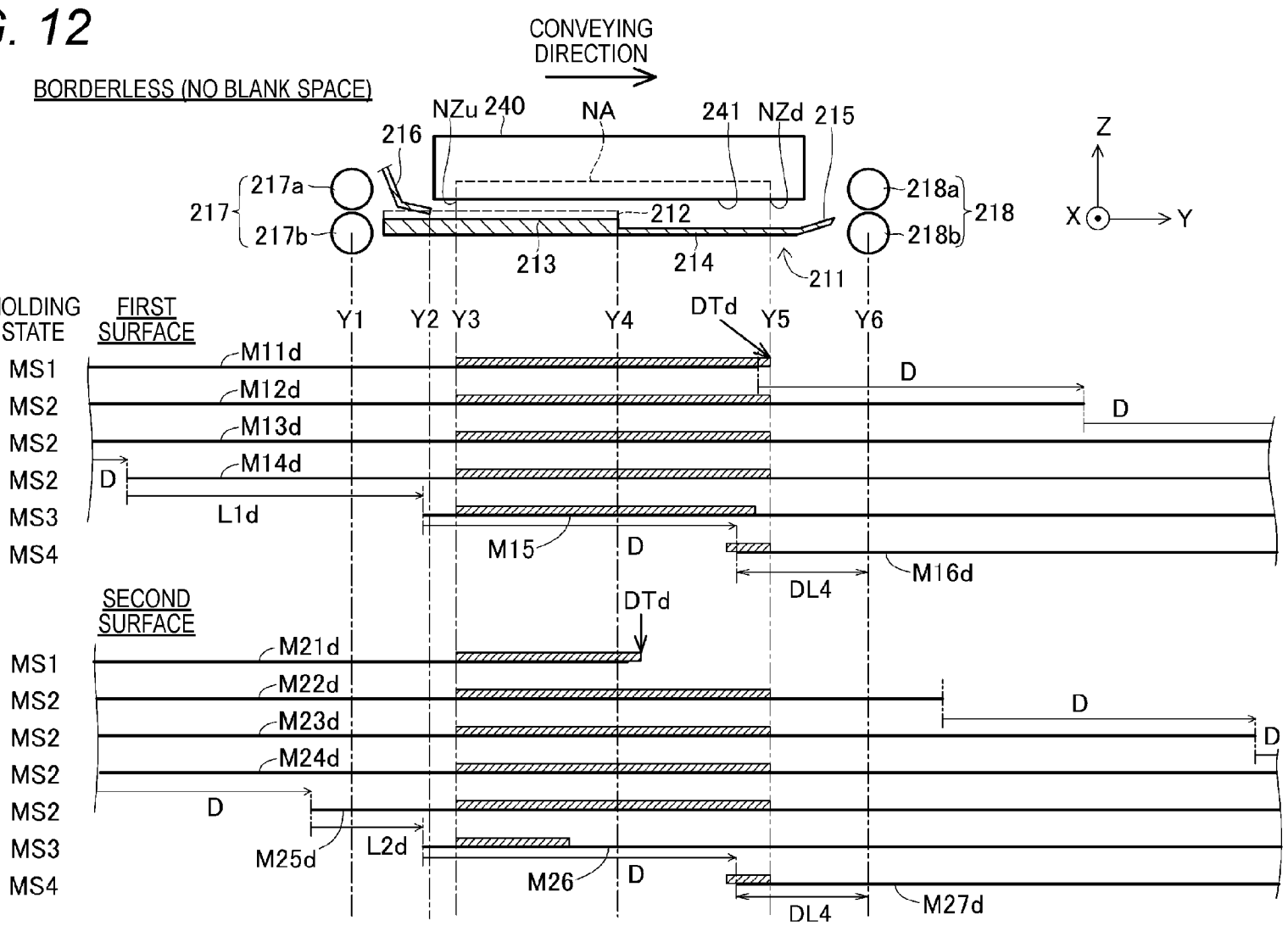
FIG. 12 is a fourth view depicting the sheet position with respect to the printing head 240 for each main scanning processing.

FIG. 12 is a fourth view depicting the sheet position with respect to the printing head 240 for each the main scanning processing. In FIG. 12, six sheet positions M11*d* to M14*d*, M15, M16*d* corresponding to the main scanning processing of six times of the printing on the first surface and seven sheet positions M21*d* to M25*d*, M26, M27*d* of the main scanning processing of seven times of the printing on the second surface are shown.

In the case of the borderless printing, the control processing of the printing on the first surface is described. The sheet position M11*d* (FIG. 11) after the first conveying processing is the usual start position. At the sheet position M11*d*, the +Y-side end of the first image, i.e., the +Y-side end DTd (FIG. 11, FIG. 12) of the printing region PAd and the most downstream nozzle NZd coincide with each other with respect to the positions in the Y direction. In other words, at the sheet position M11*d*, the +Y-side end DTd of the printing region PAd coincides with the position Y5 in the Y direction.

In the case of the borderless printing, during the printing on the end of the sheet M, the ink may be dropped outside the sheet M. For this reason, when performing the printing in the vicinity of the end of the sheet M, the end of the sheet M is preferably positioned above a part of the sheet stand 211, at which the support members 212, 213 are not formed, i.e., a part functioning as a receiving part of the ink. The reason is that when the ink is attached to the support members 212, 213, the ink attached to the support members 212, 213 may be attached to the sheet M to dirty the sheet M. At the sheet position M11*d* upon the first main scanning processing during which the printing is performed in the vicinity of the +Y-side end of the sheet M, since the +Y-side end of the sheet M is located at the +Y-side of the position Y4 of the +Y-side ends of the support members 212, 213, there is no problem.

In the case of the borderless printing, there is no blank space. Therefore, the +Y-side end DTd of the printing region Pad of the sheet M is positioned at the +Y-side of the +Y-side end DT of the case of the minimum blank space by a value (Wmin+γ) (FIG. 11). For this reason, the sheet position Mild is shifted to the −Y-side of the sheet position M11 of FIG. 5 by the value (Wmin+γ).

The sheet positions M12*d* to M14*d* after the second to fourth conveying processing are shifted to the −Y-side by the value (Wmin+γ), as compared to the sheet positions M12 to M14 of FIG. 5, like the sheet position M11*d*. The sheet position M15 after the fifth conveying processing, which is the second processing from the last processing, is the same as the sheet position M15 of FIG. 5. For this reason, in FIG. 12, the sheet position M15 is denoted with the same reference numeral as FIG. 5.

Incidentally, at the time at which the fifth main scanning processing at the sheet position M15 is over, the vicinity of the −Y-side end of the sheet M is in a state where only the printing on the minimum blank space having the width Wmin has not completed, like the case of the minimum blank space shown in FIG. 5. At the sheet position M16*d* after the sixth conveying processing, the position of the most downstream nozzle NZd coincides with the +Y-side end of the minimum blank space having the width Wmin, on which the printing has not completed yet, on the sheet M.

The head positions P11*d* to P14*d*, P15, P16*d* of FIG. 11 correspond to the sheet positions M11*d* to M14*d*, M15, M16*d* of FIG. 12, respectively. Since the head position P15 is the same as the head position P15 of FIG. 4, it is denoted with the same reference numeral as FIG. 4.

During the final sixth main scanning processing at the sheet position M16*d* (head position P16*d*), the printing is performed on the minimum blank space having the width Wmin at the −Y-side of the sheet M by using the nozzles in the value (Wmin+γ) of the +Y-side including the most downstream nozzles NZd. That is, at the sheet position M16*d*, since the −Y-side end of the sheet M is located at the +Y-side of the position Y4 of the +Y-side ends of the support members 212, 213, it becomes possible to suppress the ink from being attached to the support members 212, 213 during the sixth main scanning processing of performing the printing in the vicinity of the −Y-side end of the sheet M.

The conveying amounts of the second to fourth and sixth conveying processing are the nozzle length D, respectively. The conveying amount L1*d* of the fifth conveying processing is set to a value smaller than the nozzle length D so as to convey the sheet M to the sheet position M15.

In the case of the borderless printing, the number of nozzles to be used in the fifth main scanning processing at the head position P15 is smaller than the case of the minimum blank space by the value (Wmin+γ). The reason is described. Since there is no blank space at the +Y-side, a region that is to be printed in the vicinity of the +Y-side end is greater by the value (Wmin+γ).

During the control of the printing on the first surface, even in the case of the borderless printing, since all the nozzles in the nozzle length D are used in all the main scanning processing except for the main scanning processing, which is the second processing from the last processing, it is possible to suppress the increase in the printing time.

In the case of the borderless printing, the control processing of the printing on the second surface is described. At the sheet position M21*d* of FIG. 12 after the first conveying processing, the sheet M is in the first state MS1, like the sheet position M21 of FIG. 5 of the case of the minimum blank space. At the sheet position M21*d*, the +Y-side end of the sheet M is positioned at the +Y-side of the +Y-side end of the sheet M located at the sheet position M21 of FIG. 5. More specifically, at the sheet position M21 of FIG. 5, the +Y-side end of the sheet M is positioned at the −Y-side of the position Y4 of the +Y-side ends of the support members 212, 213. However, at the sheet position M21*d*, the +Y-side end of the sheet M is positioned at the +Y-side of the position Y4. This is to suppress the ink from being attached to the support members 212, 213 during the first main scanning processing of performing the printing in the vicinity of the +Y-side end of the sheet M.

However, at the sheet position M21*d*, the position of the +Y-side end of the sheet M is set as close as to the −Y-side within a range in which the ink is not attached to the support members 212, 213. For this reason, at the sheet position M21*d*, the +Y-side end of the sheet M is positioned at the −Y-side of the +Y-side end of the sheet M located at the sheet position M11*d* during the printing on the first surface. As a result, also in the borderless printing, during the printing on the second surface, the deformation is suppressed in the vicinity of the +Y-side end of the sheet M and the deterioration of the printing quality is suppressed within the range in which the ink is not attached to the support members 212, 213.

Thereafter, the sheet positions M22*d* to M25*d* after the second to fifth conveying processing are shifted to the +Y-side of the sheet positions M22 to M25 of FIG. 5, like the sheet position M21*d*. Also, the sheet positions M22*d* to M25*d* are shifted to the −Y-side of the sheet positions M12*d* to M15*d* upon the printing on the first surface, like the sheet position M21*d*. The sheet position M26 after the sixth conveying processing, which is the second processing from the final processing, is the same as the sheet position M26 of FIG. 5. For this reason, in FIG. 12, the sheet position M26 is denoted with the same reference numeral as FIG. 5. The sheet position M26 is also the same as the sheet position M15 upon the printing on the first surface.

Incidentally, at the time at which the sixth main scanning processing at the sheet position M25 is over, the vicinity of the −Y-side end of the sheet M is in a state where only the printing on the minimum blank space having the width Wmin has not completed, like the time at which the fifth main scanning processing of the printing on the first surface is over. The seventh conveying processing and the seventh main scanning processing are the same as the sixth conveying processing and the sixth main scanning processing during the printing on the first surface. Therefore, the sheet position M27*d* after the seventh conveying processing is the same as the sheet position M16*d* upon the printing on the first surface.

The head positions P21*d* to P25*d*, P26, P27*d* of FIG. 11 correspond to the sheet positions M21*d* to M25*d*, M26, M27*d* of FIG. 12, respectively. Since the head position P26 is the same as the head position P26 of FIG. 4, it is denoted with the same reference numeral as FIG. 4.

During the final seventh main scanning processing at the sheet position M27*d*, the printing is performed on the minimum blank space having the width Wmin at the −Y-side of the sheet M by using the nozzles in the value (Wmin+γ) of the +Y-side including the most downstream nozzles NZd, like the sixth main scanning processing of the printing on the first surface.

The conveying amounts of the second to fifth and seventh conveying processing are the nozzle length D, respectively.

A conveying amount L2*d* of the sixth conveying processing is set to a value smaller than the nozzle length D so as to convey the sheet M to the sheet position M26.

As can be seen from the above description, regarding the printing on the second surface, when there is a blank space at the +Y-side of the sheet M, the sheet position M21 is set so that the +Y-side end of the sheet M is positioned at the −Y-side of the position Y4 of the +Y-side ends of the support members 212, 213, as can be seen from the examples of the minimum blank space and the small blank space described with reference to FIG. 4, FIG. 5, FIG. 7 and FIG. 8. Also, regarding the printing on the second surface, when there is no blank space at the +Y-side of the sheet M, the sheet position M21*d* is set so that the +Y-side end of the sheet M is positioned at the +Y-side of the position Y4 of the +Y-side ends of the support members 212, 213, as can be seen from the example of the borderless printing described with reference to FIG. 11 and FIG. 12. As a result, when there is a blank space at the +Y-side of the sheet, it is possible to further suppress the deformation of the sheet. Also, when there is no blank space at the +Y-side of the sheet, it is possible to suppress the ink from being attached to the support members 212, 213 and the ink attached to the support members 212, 213 from being attached to the sheet M to dirty the sheet M.

Further, at the sheet positions M16*d*, M27*d*, the sheet M is in a fourth state MS4 where it is not held by the pair of upstream rollers 217, is not supported by the pressing members 216 and the support members 212, 213 and is held by the pair of downstream rollers 218. For this reason, at the sheet positions M16*d*, M27*d*, the vicinity of the −Y-side end of the sheet M is likely to be deformed. In the illustrative embodiment, the printing except for the minimum blank space having the width Wmin at the −Y-side has completed up to the main scanning processing that is executed at the sheet positions M15, M26 in the third state MS3 where the sheet M is more difficult to be deformed than in the fourth state MS4. During the final main scanning processing that is executed at the sheet positions M16*d*, M27*d* in the fourth state MS4, since only the printing for the minimum blank space having the width Wmin at the −Y-side is performed, it is possible to reduce the deterioration of the quality of an image that is to be printed in the vicinity of the −Y-side end. Further, during the final main scanning processing, since the nozzles in the value (Wmin+γ) of the +Y-side including the most downstream nozzles NZd are used, it is possible to relatively shorten a distance DL4 (FIG. 12) from the pair of downstream rollers 218 to the −Y-side end of the sheet M. As a result, it is possible to suppress the deformation in the vicinity of the −Y-side end of the sheet M, so that it is possible to further reduce the deterioration of the quality of an image to be printed in the vicinity of the −Y-side end.

As can be seen from the above descriptions, the sheet position M11 of FIG. 5, the sheet position M11*b* of FIG. 8, and the sheet position M11*d* of FIG. 12 are examples of the first position, respectively, the sheet position M21 of FIGS. 5 and 8 and the sheet position M21*d* of FIG. 12 are examples of the second position, respectively, and the sheet positions M15, M26 of FIG. 5, FIG. 8 and FIG. 12 are examples of the third position, respectively.

In the above illustrative embodiment, as described above, the printing region in which the first image is to be printed on the first surface and the printing region in which the second image is to be printed on the second surface are the same in terms of the sizes and the positions on the sheet M. That is, the widths BLd, BLu of the +Y-side and −Y-side blank spaces of the first surface and the widths BLd, BLu of the +Y-side and −Y-side blank spaces of the second surface are the same. As can be seen from this, the difference between the control processing of the printing on the first surface and the control processing of the printing on the second surface, specifically, the differences of the sheet positions, the head positions, the conveying amounts, the numbers of nozzles to be used, the positions of the nozzles, and the like occur even in a case where the first image to be printed on the first surface and the second image to be printed on the second surface are the same and the printing is performed with the same blank space. For example, even if the first image to be printed on the first surface and the second image to be printed on the second surface are the same and the printing is performed with the same blank space, the sheet position upon the start of the printing on the first surface, i.e., upon the first partial printing on the first surface and the sheet position upon the start of the printing on the second surface, i.e., upon the first partial printing on the second surface are different from each other. Specifically, also in this case, the +Y-side end of the sheet position (for example, the sheet position M21 of FIG. 5) upon the first partial printing on the second surface is positioned at the −Y-side of the +Y-side end of the sheet position (for example, the sheet position M11 of FIG. 5) upon the first partial printing on the first surface. Also, even if the first image to be printed on the first surface and the second image to be printed on the second surface are the same and the printing is performed with the same blank space, the first partial printing on the first surface is performed using the N1 nozzles (N1: integer of 2 or greater), and the first partial printing on the second surface is performed using the N2 nozzles (N2: an integer of 1 or greater and less than N1).

Modified Embodiments (1) In the above illustrative embodiment, for example, in the case of the minimum blank space, the sheet position M21 after the first conveying processing of the printing on the second surface is different from the sheet position M11 after the first conveying processing of the printing on the first surface, and the number of nozzles to be used in the first main scanning processing of the printing on the second surface is smaller than the number of nozzles to be used in the first main scanning processing of the printing on the first surface. Instead of this configuration, the sheet position after the first conveying processing of the printing on the second surface may be the same as the sheet position M11 after the first conveying processing of the printing on the first surface, and the number of nozzles to be used in the first main scanning processing of the printing on the second surface may be smaller than the number of nozzles to be used in the first main scanning processing of the printing on the first surface. This is also the same for the cases of the small blank space and the borderless printing.

Figure 13:
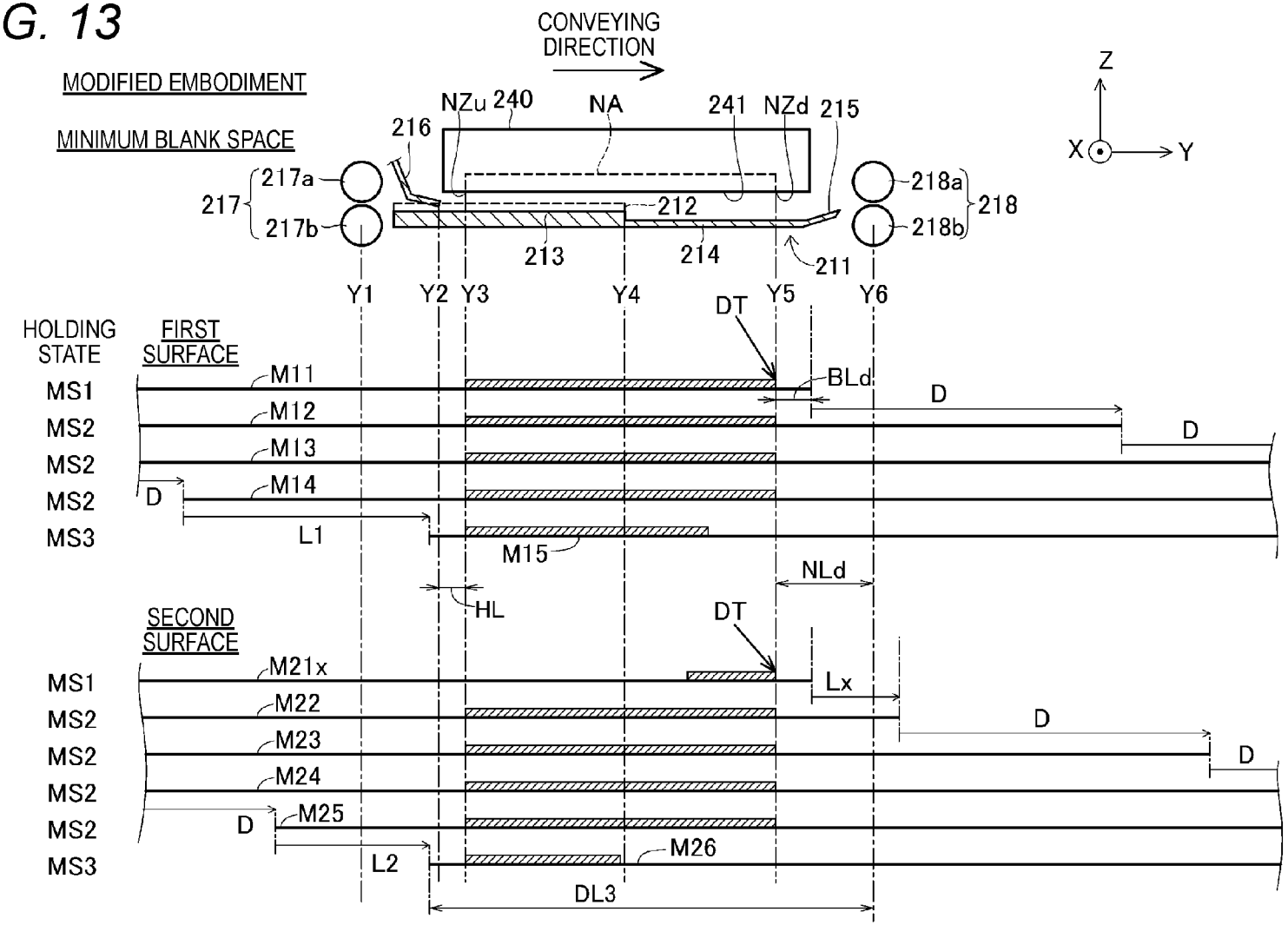
FIG. 13 is a view depicting the head position with respect to the sheet M for each main scanning processing, in a modified embodiment.

FIG. 13 depicts the head position with respect to the sheet M for each main scanning processing, in a modified embodiment. In the example of FIG. 13, a sheet position M21*x* after the first conveying processing of the printing on the second surface is the same as the sheet position M11 after the first conveying processing of the printing on the first surface. Also, a conveying amount during the second conveying processing of the printing on the second surface is set to an amount Lx less than the nozzle length D, unlike the example of FIG. 5. Also, the nozzles to be used in the first main scanning processing of the printing on the second surface are some downstream nozzles including the most downstream nozzles NZd, unlike the example of FIG. 5. Incidentally, the number of nozzles to be used in the first main scanning processing of the printing on the second surface is the same as the example of FIG. 5. Also, the other configurations, for example, the sheet positions M11 to M15, M22 to M26 are the same as the example of FIG. 5.

Also in this case, during the printing on the second surface, it is possible to set the printing amount in the first main scanning processing, which is to be executed in the first state MS1, to be less than the printing amount during the printing on the first surface. As a result, when performing the printing in the vicinity of the +Y-side end of the second surface of the sheet, it is possible to suppress the deformation of the sheet immediately after the printing. Therefore, it is possible to reduce the deterioration of the printing quality in the vicinity of the +Y-side end of the sheet.

(2) In the above illustrative embodiment, the distance DL2 from the pair of upstream rollers 217 to the +Y-side end of the sheet Mat the sheet position M21 during the printing on the second surface is set to be 50% or less of the distance DL1 at the sheet position M11 during the printing on the first surface. The distance DL2 is not limited thereto but is preferably as shorter as possible, as compared to the distance DL1. For example, the distance DL2 is preferably 75% or less of the distance DL1, more preferably 50% or less, and particularly preferably 30% or less.

(3) In the above illustrative embodiment, the printing is performed using the one pass printing in which a pass number PS is one. Instead of this configuration, the printing may be performed using a printing method having the pass number PS such as 2, 4 or the like different from the pass number PS 1. The pass number PS indicates the number of main scanning processing necessary to perform the printing in one region on the sheet M, for example, a partial region in which a width in the conveying direction is the nozzle length D. Even when the printing method of any pass number PS is used, the +Y-side end of the sheet M during the first main scanning processing of the printing on the second surface in the first state MS1 is preferably positioned at the −Y-side of the +Y-side end of the sheet M during the first main scanning processing of the printing on the first surface in the first state MS1. Also, the number of nozzles to be used during the first main scanning processing of the printing on the second surface in the first state MS1 is preferably smaller than the number of nozzles to be used during the first main scanning processing of the printing on the first surface in the first state MS1.

(4) In the above illustrative embodiment, for example, in the case of the minimum blank space, the sheet position M21 during the first main scanning processing of the printing on the second surface is made to be different from the sheet position M11 during the first main scanning processing of the printing on the first surface, so that it is possible to reduce the deterioration of the printing quality and to suppress the increase in the printing time in the vicinity of the +Y-side end of the sheet M. In addition to this configuration, the sheet position during the first main scanning processing of the printing on the second surface may be made to be different from the sheet position during the final main scanning processing after the first conveying processing of the printing on the first surface. For example, when the final main scanning processing is executed in the fourth state MS4, the vicinity of the −Y-side end of the sheet M is likely to be deformed. In this case, for example, the first conveying processing may be controlled so that the −Y-side end of the sheet M located at the sheet position during the final main scanning processing of the printing on the second surface is positioned at the +Y-side of the −Y-side end of the sheet M located at the sheet position during the final main scanning processing of the printing on the first surface. By doing so, it is possible to reduce the deterioration of the printing quality and to suppress the increase in the printing time in the vicinity of the −Y-side end of the sheet M.

(5) In the above illustrative embodiment, the printing mechanism 200 has the reversal mechanism 219, and the sheet M is automatically reversed using the reversal mechanism 219. Instead of this configuration, the printing mechanism 200 may not have the reversal mechanism 219. In this case, for example, when the printing on the first surface has completed, the CPU 110 discharges the sheet for which the printing on the first surface has completed to the discharge tray. The user manually loads the sheet M discharged to the discharge tray on a sheet feeding tray, and then inputs a start instruction of the printing on the second surface into the printer 10 through the operation device 150. The CPU 110 may start the control processing of the printing on the second surface, based on the input start instruction.

(6) In the above illustrative embodiment, the computer program 132 (FIG. 1) is executed, so that the CPU 110 of the printer 10 implements the control processing of the duplex printing of repeating the conveying processing and the main scanning processing, as shown in FIGS. 4 to 12. Instead of this configuration, a CPU of an external device such as a personal computer connected to the printer may execute a printer driver program to execute the control processing of the illustrative embodiment, thereby enabling the printer to execute the duplex printing.

In this case, for example, the CPU of the external device is configured to execute the rasterizing processing, the color conversion processing and the halftone processing described in the illustrative embodiment by using target image data (for example, image data compressed with JPEG, image data described with the page description language) indicative of an image of a printing target, thereby generating dot data. The CPU of the external device is also configured to use the dot data, thereby generating a print job including print data, which is to be obtained by rearranging the dot data in order with which the dot data is to be used in the plurality of main scanning processing, and control data for controlling the printer. The control data includes data for designating the using nozzles to be used in the plurality of main scanning processing and data for designating the conveying amounts in the plurality of conveying processing, for example. The CPU of the external device is also configured to supply the generated print job to the printer, and the printer is configured to execute the printing in accordance with the supplied print job.

As can be seen from the above descriptions, in the above illustrative embodiment, the printing mechanism 200 (FIG. 1) is an example of the printing execution unit, and in this modified embodiment, the printer to which the print job is to be supplied is an example of the printing execution unit.

(7) In the above illustrative embodiment, a flat plate may be used for the sheet stand 211 (FIG. 3) of the conveyance mechanism 210. That is, the sheet stand 211 may not have the plurality of support members 212, 213, and the conveyance mechanism 210 may not have the pressing members 216. That is, in the above illustrative embodiment, the sheet M being conveyed may not be supported by the plurality of support members 212, 213 and the pressing members 216.

Further, the sheet stand 211 may have the plurality of support members 212, 213, and the conveyance mechanism 210 may not have the pressing members 216. That is, for example, the sheet M located at the sheet position M21, M21*d* or the sheet position M11, M11*d* may not be supported from the printing surface-side and may be supported from the opposite surface-side to the printing surface by the plurality of support members 212, 213 between the pair of upstream rollers 217 and the pair of downstream rollers 218.

(8) In the above illustrative embodiment, the conveyance mechanism 210 may have a support member configured to support the sheet M in a flat form without deforming the same into a waveform, instead of the support member configured to support the sheet M with deforming the same into a waveform along the X direction. For example, the sheet stand 211 (FIG. 3) may have only the plurality of low support members 213 without the plurality of high support members 212, and the conveyance mechanism 210 may have the plurality of pressing members 216. Incidentally, preferably, the member (for example, the support members 212, 213) configured to support the sheet M from the opposite surface-side to the printing surface is provided at a position in the Y direction at which the member (for example, the pressing members 216) configured to support the sheet M at least from the printing surface is positioned, and is configured to support the sheet M from both surfaces.

Also, the conveyance mechanism 210 may have only the plurality of low support members 213 without the plurality of high support members 212, and the conveyance mechanism 210 may not have the plurality of pressing members 216. Like this, the sheet M may be supported to be flat from the opposite surface-side to the printing surface by the plurality of low support members 213 without being supported from the printing surface-side between the pair of upstream rollers 217 and the pair of downstream rollers 218.

(9) In the above illustrative embodiment, the control processing of FIG. 6 may be appropriately changed or omitted. For example, the processing of S100 and S135 of FIG. 6 may be omitted, and the sheet M may be conveyed to the special start position during the first conveying processing of the printing on the second surface, irrespective of the types of the sheet. Also, the processing of S140 of FIG. 6 may be omitted, and the sheet M may be conveyed to the special start position during the first conveying processing of the printing on the second surface, irrespective of the printing amounts on the first surface in the vicinity of the +Y-side end of the sheet M. Also, the processing of S145 of FIG. 6 may be omitted, and the sheet M may be conveyed to the special start position during the first conveying processing of the printing on the second surface, irrespective of the width BLd of the +Y-side blank space of the sheet M.

(10) In the above embodiments, some of the configurations implemented by the hardware may be replaced with the software, and some or all of the configurations implemented by the software may be replaced with the hardware.

Although the disclosure has been described on the basis of the illustrative embodiment and the modified embodiments, the embodiments of the disclosure are provided to easily understand the disclosure and are not construed to limit the disclosure. The disclosure can be changed and improved without departing from the gist thereof and the claims, and includes the equivalents thereof.

What is claimed is:

1. A control device of a printing execution mechanism,
the printing execution mechanism comprising:
a printing head having a plurality of nozzles configured to discharge liquid droplets; and
a conveyance mechanism configured to convey a sheet in a conveying direction, the conveyance mechanism comprising:
an upstream holding member provided at a more upstream side than the printing head in the conveying direction, the upstream holding member being configured to hold the sheet; and
a downstream holding member provided at a more downstream side than the printing head in the conveying direction, the downstream holding member being configured to hold the sheet,
the printing execution mechanism being configured to perform a printing by alternately executing a partial printing by the printing head and conveyance of the sheet by the conveyance mechanism for a plurality of times,
the control device being configured to:
execute first control processing of controlling the printing execution mechanism to perform the printing on a first surface of the sheet, the first control processing comprising:
conveying the sheet to a first position in the conveying direction by the conveyance mechanism, the first position being a position at which:
the sheet is to be held by the upstream holding member;
the sheet is not to be held by the downstream holding member; and
a downstream end of the sheet is located between the upstream holding member and the downstream holding member; and
starting the printing on the first surface of the sheet by executing the partial printing on the first surface of the sheet located at the first position by the printing head after the sheet is conveyed to the first position in the first control processing; and
execute second control processing of controlling the printing execution mechanism to perform the printing on a second surface of the sheet after the first control processing is executed, the second control processing comprising:
conveying the sheet to a second position in the conveying direction by the conveyance mechanism, the second position being a position at which:
the sheet is to be held by the upstream holding member;
the sheet is not to be held by the downstream holding member; and
the downstream end of the sheet is located at a more upstream side than the downstream end of the sheet located at the first position; and
starting the printing on the second surface of the sheet by executing the partial printing on the second surface of the sheet located at the second position by the printing head after the sheet is conveyed to the second position in the second control processing.

2. The control device according to claim 1,
wherein the first control processing further comprises:
conveying the sheet to a third position in the conveying direction by the conveyance mechanism; and
executing the partial printing on the first surface of the sheet located at the third position by the printing head after the sheet is conveyed to the third position in the first control processing,
wherein the second control processing further comprises:
conveying the sheet to the third position by the conveyance mechanism; and
executing the partial printing on the second surface of the sheet located at the third position by the printing head after the sheet is conveyed to the third position in the second control processing, and wherein the third position is a position at which the sheet is not to be held by the upstream holding member and is to be held by the downstream holding member.

3. The control device according to claim 2, wherein the conveyance mechanism further comprises a first support member provided at a position in the conveying direction between the upstream holding member and a most upstream nozzle of the plurality of nozzles in the conveying direction, the first support member being configured to support the sheet from the same direction as the printing head, wherein a distance between the most upstream nozzle and the first support member in the conveying direction is less than a width in the conveying direction of a blank space provided at the upstream side of the sheet in the conveying direction during the printing on the first surface and the second surface, and wherein the third position is a position at which:

the sheet is not to be held by the upstream holding member;

the sheet is to be held by the downstream holding member; and the sheet is to be supported by the first support member.

4. The control device according to claim 3, wherein the conveyance mechanism further comprises a second support member provided at least at a position in the conveying direction, at which the first support member is located, the second support member being configured to support the sheet from a direction opposite to the printing head, and wherein the third position is a position at which:

the sheet is not to be held by the upstream holding member;

the sheet is to be held by the downstream holding member; and the sheet is to be supported by the first support member and the second support member.

5. The control device according to claim 2, wherein the conveyance mechanism further comprises a second support member provided at a position in the conveying direction, the second support member being configured to support the sheet from a direction opposite to the printing head, and wherein the third position is a position at which:

the sheet is not to be held by the upstream holding member;

the sheet is to be held by the downstream holding member; and the sheet is to be supported by the second support member.

6. The control device according to claim 1, wherein the plurality of nozzles is disposed in the conveying direction and comprises a first nozzle and a second nozzle positioned at the more downstream side than the first nozzle in the conveying direction, wherein in the first control processing, the control device is configured to control the printing execution mechanism to execute the partial printing on the first surface of the sheet located at the first position by using the first nozzle and the second nozzle, and wherein in the second control processing, the control device is configured to control the printing execution mechanism to execute the partial printing on the second surface of the sheet located at the second position by using the first nozzle without using the second nozzle.

7. The control device according to claim 1, wherein in the first control processing, the control device is configured to control the print execution mechanism to execute the partial printing on the first surface of the sheet located at the first position by using N1 nozzles of the plurality of nozzles, where N1 is an integer of 2 or greater, and wherein in the second control processing, the control device is configured to control the printing execution mechanism to execute the partial printing on the second surface of the sheet located at the second position by using N2 nozzles of the plurality of nozzles, where N2 is an integer of 1 or greater and less than N1.

8. The control device according to claim 1, wherein in the second control processing, the control device is configured to:

when a downstream blank space of the sheet has a first width in the conveying direction, control the printing execution mechanism to execute the partial printing on the second surface of the sheet located at the second position by using N3 nozzles of the plurality of nozzles, where N3 is an integer of 2 or greater, and when the downstream blank space of the sheet has a second width in the conveying direction greater than the first width, control the printing execution mechanism to execute the partial printing on the second surface of the sheet located at the second position by using N4 nozzles of the plurality of nozzles, where N4 is an integer of 1 or greater and less than N3.

9. The control device according to claim 1, wherein the first control processing consists of one set of processing, which comprises the partial printing by the printing head and the conveyance of the sheet by the conveyance mechanism, for K1 times, where K1 is an integer of 2 or greater, and wherein the second control processing consists of the one set of processing for K2 times, where K2 is an integer greater than K1.

10. The control device according to claim 1, wherein the conveyance mechanism further comprises a third support member provided between the upstream holding member and the downstream holding member at a position closer to the upstream holding member than to the downstream holding member, the third support member being configured to support the sheet from a direction opposite to the printing head, and wherein in the second control processing, the control device is configured to:

when there is a blank space at a downstream side of the sheet, set the second position such that the downstream end of the sheet is positioned at a more upstream side than a downstream end of the third support member; and when there is no blank space at the downstream side of the sheet, set the second position such that the downstream end of the sheet is positioned at a more downstream side than the downstream end of the third support member.

11. The control device according to claim 1, wherein the second position is set such that a length in the conveying direction from the downstream end of the sheet to the downstream holding member is equal to or less than a length in the conveying direction from a most upstream nozzle of the plurality of nozzles in the conveying direction to a most downstream nozzle in the conveying direction.

12. The control device according to claim 1, wherein the first control processing and the second control processing comprise conveying the sheet by the conveyance mechanism by a length, which is to be obtained by adding a length in the conveying direction between two adjacent nozzles in the conveying direction of the plurality of nozzles to a length in the conveying direction from a most upstream nozzle of the plurality of nozzles in the conveying direction to a most downstream nozzle in the conveying direction.

13. The control device according to claim 1, wherein the conveyance mechanism further comprises:

a fourth support member provided at a position in the conveying direction between the upstream holding member and a most upstream nozzle of the plurality of nozzles, the fourth support member being configured to support the sheet from the same direction as the printing head; and a fifth support member provided at least at a position in the conveying direction, at which the fourth support member is located, the fifth support member being configured to support the sheet from a direction opposite to the printing head, and wherein the fourth support member and the fifth support member are configured to support the sheet such that the sheet is to be deformed into a waveform along a direction intersecting with the conveying direction.

14. The control device according to claim 13, wherein a position of a downstream end of the fifth support member is located between a most upstream nozzle and a most downstream nozzle of the plurality of nozzles, and wherein the second position is a position at which the downstream end of the sheet is located at a more upstream side than the downstream end of the fifth support member.

15. The control device according to claim 1, wherein the control device is further configured to specify a type of the sheet, wherein when it is specified that the sheet is a first type sheet, the second control processing comprises:

conveying the sheet to the second position in the conveying direction by the conveyance mechanism; and starting the printing on the second surface by executing the partial printing on the second surface of the sheet located at the second position by the printing head after the sheet is conveyed to the second position in the second control processing, and wherein when it is specified that the sheet is a second type sheet, the second control processing comprises:

conveying the sheet to the first position in the conveying direction by the conveyance mechanism; and starting the printing on the second surface by executing the partial printing on the second surface of the sheet located at the first position by the printing head after the sheet is conveyed to the first position in the second control processing.

16. The control device according to claim 1, wherein the control device is further configured to determine whether a printing amount printed already during the printing on the first surface is equal to or greater than a reference, for a downstream end portion in the conveying direction of the sheet during the printing on the second surface, wherein when it is determined that the printing amount is equal to or greater than the reference, the second control processing comprises starting the printing on the second surface by conveying the sheet to the second position in the conveying direction by the conveyance mechanism and then executing the partial printing on the second surface of the sheet located at the second position by the printing head, and wherein when it is determined that the printing amount is less than the reference, the second control processing comprises starting the printing on the second surface by conveying the sheet to the first position in the conveying direction by the conveyance mechanism and then executing the partial printing on the second surface of the sheet located at the first position by the printing head.

17. A control device of a printing execution mechanism, the printing execution mechanism comprising:

a printing head having a plurality of nozzles configured to discharge liquid droplets; and a conveyance mechanism configured to convey a sheet in a conveying direction, the conveyance mechanism comprising:

an upstream holding member provided at a more upstream side than the printing head in the conveying direction, the upstream holding member being configured to hold the sheet; and a downstream holding member provided at a more downstream side than the printing head in the conveying direction, the downstream holding member being configured to hold the sheet, the printing execution mechanism being configured to perform a printing by alternately executing a partial printing by the printing head and conveyance of the sheet by the conveyance mechanism for a plurality of times, the control device being configured to:

execute first control processing of controlling the printing execution mechanism to perform the printing on a first surface of the sheet, the first control processing comprising:

conveying the sheet to a first position in the conveying direction by the conveyance mechanism; and starting the printing on the first surface by executing the partial printing on the first surface of the sheet located at the first position by using N1 nozzles of the plurality of nozzles by the printing head after the sheet is conveyed to the first position in the first control processing, where N1 is an integer of 2 or greater; and execute second control processing of controlling the printing execution mechanism to perform the printing on a second surface of the sheet after the first control processing is executed, the second control processing comprising:

conveying the sheet to a second position in the conveying direction by the conveyance mechanism; and starting the printing on the second surface by executing the partial printing on the second surface of the sheet located at the second position by using N2 nozzles of the plurality of nozzles by the printing head after the sheet is conveyed to the second position in the second control processing, where N2 is an integer of 1 or greater and less than N1, wherein the first position and the second position are positions at which:

the sheet is to be held by the upstream holding member;

the sheet is not to be held by the downstream holding member; and a downstream end of the sheet is located between the upstream holding member and the downstream holding member.

18. A non-transitory computer-readable medium having a computer program for controlling a printing execution mechanism stored thereon and readable by a computer, the printing execution mechanism comprising:

a printing head having a plurality of nozzles configured to discharge liquid droplets; and a conveyance mechanism configured to convey a sheet in a conveying direction, the conveyance mechanism comprising:

an upstream holding member provided at a more upstream side than the printing head in the conveying direction, the upstream holding member being configured to hold the sheet; and a downstream holding member provided at a more downstream side than the printing head in the conveying direction, the downstream holding member being configured to hold the sheet, the printing execution mechanism being configured to perform a printing by alternately executing a partial printing by the printing head and conveyance of the sheet by the conveyance mechanism for a plurality of times, the computer program, when executed by the computer, causes the computer to perform operations comprising:

executing first control processing of controlling the printing execution mechanism to perform the printing on a first surface of the sheet, the first control processing comprising:

conveying the sheet to a first position in the conveying direction by the conveyance mechanism, the first position being a position at which:

the sheet is to be held by the upstream holding member;

the sheet is not to be held by the downstream holding member; and a downstream end of the sheet is located between the upstream holding member and the downstream holding member; and starting the printing on the first surface by executing the partial printing on the first surface of the sheet located at the first position by the printing head after the sheet is conveyed to the first position in the first control processing; and executing second control processing of controlling the printing execution mechanism to perform the printing on a second surface of the sheet after the first control processing is executed, the second control processing comprising:

conveying the sheet to a second position in the conveying direction by the conveyance mechanism, the second position being a position at which:

the sheet is to be held by the upstream holding member;

the sheet is not to be held by the downstream holding member; and the downstream end of the sheet is located at a more upstream side than the downstream end of the sheet located at the first position; and starting the printing on the second surface by executing the partial printing on the second surface of the sheet located at the second position by the printing head after the sheet is conveyed to the second position in the second control processing.

19. A non-transitory computer-readable medium having a computer program for controlling a printing execution mechanism stored thereon and readable by a computer, the printing execution mechanism comprising:

a printing head having a plurality of nozzles configured to discharge liquid droplets; and a conveyance mechanism configured to convey a sheet in a conveying direction, the conveyance mechanism comprising:

an upstream holding member provided at a more upstream side than the printing head in the conveying direction, the upstream holding member being configured to hold the sheet; and a downstream holding member provided at a more downstream side than the printing head in the conveying direction, the downstream holding member being configured to hold the sheet, the printing execution mechanism being configured to perform a printing by alternately executing a partial printing by the printing head and conveyance of the sheet by the conveyance mechanism for a plurality of times, the computer program, when executed by the computer, causes the computer to perform operations comprising:

executing first control processing comprising controlling the printing execution mechanism to perform the printing on a first surface of the sheet, the first control processing comprising:

conveying the sheet to a first position in the conveying direction by the conveyance mechanism; and starting the printing on the first surface by executing the partial printing on the first surface of the sheet located at the first position by using N1 nozzles of the plurality of nozzles by the printing head after the sheet is conveyed to the first position in the first control processing, where N1 is an integer of 2 or greater; and executing second control processing of controlling the printing execution mechanism to perform the printing on a second surface of the sheet after the first control processing is executed, the second control processing comprising:

conveying the sheet to a second position in the conveying direction by the conveyance mechanism; and starting the printing on the second surface by executing the partial printing on the second surface of the sheet located at the second position in the conveying direction by using N2 nozzles of the plurality of nozzles by the printing head after the sheet is conveyed to the second position in the second control processing, where N2 is an integer of 1 or greater and less than N1, wherein the first position and the second position are positions at which:

the sheet is to be held by the upstream holding member;

the sheet is not to be held by the downstream holding member; and a downstream end of the sheet is located between the upstream holding member and the downstream holding member.

* * * * *